US011471361B2

(12) United States Patent
Bardgett et al.

(10) Patent No.: US 11,471,361 B2
(45) Date of Patent: Oct. 18, 2022

(54) WHEELCHAIR FOR ASSISTING WALKING

(71) Applicant: LIFEBLOOM, Loos (FR)

(72) Inventors: Marc Bardgett, Montrouge (FR); Damien Roche, Bois Colombes (FR)

(73) Assignee: LIFEBLOOM, Loos (FR)

( * ) Notice: Subject to any disclaimer, the term of this patent is extended or adjusted under 35 U.S.C. 154(b) by 491 days.

(21) Appl. No.: 16/486,384

(22) PCT Filed: Feb. 21, 2018

(86) PCT No.: PCT/FR2018/050406

§ 371 (c)(1),
(2) Date: Aug. 15, 2019

(87) PCT Pub. No.: WO2018/154234

PCT Pub. Date: Aug. 30, 2018

(65) Prior Publication Data

US 2020/0237602 A1 Jul. 30, 2020

(30) Foreign Application Priority Data

Feb. 21, 2017 (FR) ..... 1751377

(51) Int. Cl.
*A61H 3/04* (2006.01)
*A61G 5/12* (2006.01)
(Continued)

(52) U.S. Cl.
CPC ..... *A61H 3/04* (2013.01); *A61G 5/02* (2013.01); *A61G 5/1059* (2013.01); *A61G 5/124* (2016.11);
(Continued)

(58) Field of Classification Search
CPC ..... A61G 5/14; A61G 5/1059; A61G 5/124; A61H 3/04; A61H 2201/1633
See application file for complete search history.

(56) References Cited

U.S. PATENT DOCUMENTS 4,598,944 A 7/1986 Meyer et al.
4,884,841 A 12/1989 Holley
(Continued)

FOREIGN PATENT DOCUMENTS

CN 101103946 A 1/2008
CN 201248811 Y 6/2009
(Continued)

OTHER PUBLICATIONS

Search Report for Singapore Patent Application No. 11201907620W dated Nov. 11, 2020.
(Continued)

*Primary Examiner* — Jacob B Meyer
*Assistant Examiner* — Harold Eric Pahlck, III
(74) *Attorney, Agent, or Firm* — Pearne & Gordon LLP

(57) ABSTRACT

The invention concerns a wheelchair for assisting walking. The wheelchair comprises a chassis, a movable base that can move relative to the chassis between a low seating position and a high walking position, and a device for changing the position of the base. The device for changing the position comprises at least a first arm and a linear actuator. The arm forms a third-class lever. The linear actuator is configured to bias the movable base towards the high position by means of the arm.

15 Claims, 22 Drawing Sheets

(51) Int. Cl.
*A61G 5/02* (2006.01)
*A61G 5/10* (2006.01)

(52) U.S. Cl.
CPC ..... *A61H 2201/1633* (2013.01); *A61H 2201/1642* (2013.01)

(56) References Cited

U.S. PATENT DOCUMENTS

| | | | | |
|---|---|---|---|---|
| 5,556,121 | A | 9/1996 | Pillot | |
| 8,151,812 | B2 * | 4/2012 | Razon | A61H 3/04 135/66 |
| D740,721 | S | 10/2015 | Shaw et al. | |
| 2003/0146601 | A1 | 8/2003 | Gutierrez | |
| 2004/0002407 | A1 | 1/2004 | Hawkes et al. | |
| 2007/0194547 | A1 | 8/2007 | Steiner et al. | |
| 2007/0278761 | A1 | 12/2007 | Firth | |
| 2010/0007180 | A1 * | 1/2010 | Ovre | A61G 5/127 297/68 |
| 2010/0207354 | A1 | 8/2010 | Hunziker | |
| 2012/0000496 | A1 | 1/2012 | Razon | |
| 2012/0133113 | A1 * | 5/2012 | Takamoto | A61G 5/127 280/657 |
| 2015/0202102 | A1 | 7/2015 | Dunham | |
| 2015/0265490 | A1 | 9/2015 | Cestari Soto et al. | |
| 2016/0120715 | A1 | 5/2016 | Farmer | |
| 2016/0166454 | A1 | 6/2016 | Johnson et al. | |
| 2016/0270988 | A1 * | 9/2016 | Diaz-Flores | A61G 5/046 |
| 2016/0270991 | A1 | 9/2016 | Maurer et al. | |
| 2016/0331610 | A1 | 11/2016 | Brown et al. | |

FOREIGN PATENT DOCUMENTS

| | | | |
|---|---|---|---|
| CN | 202313991 | U | 7/2012 |
| CN | 102846440 | A | 1/2013 |
| CN | 103156739 | A | 6/2013 |
| CN | 103313687 | A | 9/2013 |
| CN | 103767855 | A | 5/2014 |
| CN | 104053424 | A | 9/2014 |
| CN | 104382702 | A | 3/2015 |
| CN | 104783989 | A | 7/2015 |
| CN | 104856843 | A | 8/2015 |
| CN | 205459437 | U | 8/2016 |
| DE | 102009050734 | A1 | 4/2011 |
| EP | 2401995 | A1 | 1/2012 |
| EP | 3078363 | A1 | 10/2016 |
| FR | 2529456 | A1 | 1/1984 |
| FR | 2769830 | A1 | 4/1999 |
| GB | 2154871 | A | 9/1985 |
| GB | 2538953 | A | 12/2016 |
| JP | 08-66440 | A | 3/1996 |
| JP | H09-569 | A | 1/1997 |
| JP | H11-70146 | A | 3/1999 |
| JP | 2000254179 | A | 9/2000 |
| JP | 2001321404 | A | 11/2001 |
| JP | 2007244817 | A | 9/2007 |
| JP | 2009233090 | A | 10/2009 |
| JP | 2011072799 | A | 4/2011 |
| JP | 2013085716 | A | 5/2013 |
| KR | 20100044360 | A | 4/2010 |
| SE | 427 895 | B | 5/1983 |
| WO | 2012118263 | A1 | 9/2012 |
| WO | 2014175707 | A1 | 10/2014 |
| WO | 2015103044 | A1 | 7/2015 |
| WO | 2015189760 | A1 | 12/2015 |
| WO | 2016010863 | A1 | 1/2016 |

OTHER PUBLICATIONS

Search Report for Chinese Patent Application No. 2018800130853 dated Sep. 28, 2020.
International Search Report for International Application No. PCT/FR2018/050406 dated May 24, 2018.
Written Opinion for International Application No. PCT/FR2018/050406 dated May 24, 2018.
Preliminary Search Report for French Application No. 1751377 dated Oct. 13, 2017.

* cited by examiner

WHEELCHAIR FOR ASSISTING WALKING

TECHNICAL FIELD

The invention relates to walking aid devices and wheelchairs, in particular for mobility impaired people.

STATE OF PRIOR ART

Stand assist wheelchairs and movable seat walkers are for example known from documents US 2007/0278761 and WO 2016/010863.

More generally, there are wheelchairs which help a mobility impaired person to stand-up and walk. Some of these chairs comprise in particular a chassis, a movable seat, and a seat rising system.

The movable-seat is in particular moved relative to the chassis between a high position and a low sitting position, under the effect of at least one cylinder. In the high position, the movable seat is behind the user.

In a movable-seat walker such as that of document EP 2 401 995, the movement of the seat between its low position and its high position is performed with a rather counter intuitive and unnatural motion for rising the user, the seat rising being essentially vertical with a slight backward movement and then a slight forward movement with respect to the chassis.

Some of these walking aid wheelchairs have a highly reduced walking space. On the other hand, some of these wheelchairs or movable seat walkers do not prevent a mobility impaired person from falling down.

DISCLOSURE OF THE INVENTION

The invention aims at solving at least partially the problems encountered in solutions of prior art.

In this regard, one object of the invention is a walking aid wheelchair. The walking aid chair comprises a chassis, a movable base plate and a position changing device for the base plate.

The movable base plate is movable relative to the chassis between a low sitting position in which a user can sit thereon, and a high walking position in which it is configured to be in contact with the user and at least partially behind the user.

The position changing device for the base plate is configured to move the base between its high position and its low position. The position changing device comprises at least one first arm and a linear actuator. The first arm extends between the chassis and the base plate.

The linear actuator is connected through a lower mechanical connection to the chassis and through an upper mechanical connection to the first arm. The linear actuator is configured to bias the movable base plate to the high position through the first arm.

According to the invention, the arm is connected at its lower end through a lower hinge to the chassis and at its upper end through an upper hinge to the movable base plate, the upper hinge being located behind the lower hinge over the entire stroke of the movable base plate when the movable base plate moves from the low position to the high position. The arm forms an effort in the middle-type lever, also called third class lever.

Thanks to the invention, the chair user can switch from the low sitting position to the high walking position, with a reduced or even eliminated risk of falling from the chair. On the other hand, the movement of the movable base plate upon switching from the low sitting position to the high walking position can be performed with a motion relative to the chassis which is upward and forward and which better respects the user's natural motion to stand-up. The wheelchair may require a moderate effort from the user to stand-up and walk. In particular, it is adapted to reeducate the user in walking or maintaining him/her capable of walking, in particular on his/her own and securely.

In particular, the position changing device moves the chassis forward with respect to the base plate, when the user desires to sit down or when the user tends to fall either rearward or substantially vertically.

The actuator can help the user to stand-up. It enables in particular the position changing device to at least partially support the user's weight upon switching from the low position to the high position, while allowing switching from the high position to the low position using the user's weight exerted onto the movable base plate.

The wheelchair has a dynamic seat, the position of the movable base plate with respect to the chassis being variable as a function of the weight exerted by the user onto the movable base plate, in particular upon walking.

In particular because of the effort in the middle lever, also called third class lever, the tilt of the first arm and possibly the tilt of the actuator of the first arm, the bulk of the rising device is reduced. Thereby, the user may enjoy a relatively significant walking space.

The chair is a walking aid wheelchair, in that it enables the user, for example a mobility impaired person, to walk more normally, in particular with his/her feet in contact with the ground. The wheelchair may accompany the user in his/her movement when he/she walks.

Advantageously, the upper end of the arm is configured to form a maximum angle with the horizontal counterclockwise ensuring that for this angle, the absolute value of the moment normal to the arm exerted by the actuator is strictly lower than the absolute value of the moment normal to the arm exerted by the user when he/she applies most of his/her weight, preferably all his/her weight onto the movable base plate.

The increase in the actuator angle with the normal to the arm with the rising may enable a more significant push force to be exerted in the low sitting position than in the high walking position. The weight that the user exerts onto the movable base plate to sit down may thus remain moderate with respect to the base upward bias force of the base plate by the actuator. In particular, this upward bias of the actuator thus does not block the user in the high position. Consequently, he/she can lower himself/herself under the effect of his/her weight without the risk of moving rearwardly risk when he/she tends to sit down in the chair or to fall vertically or rearward.

The invention can optionally include one or more of the following characteristics combined to each other or not.

According to a particular embodiment, each linear actuator comprises an elastic return means configured to elastically bias the movable base plate to the high position through the first arm.

The movable base plate can thereby partially support the user's weight upon when he/she rises, sits down and walks. The position of the movable base plate with respect to the chassis may depend more on the weight exerted by the user onto the movable base plate. In other words, the wheelchair has a more dynamic seat.

Preferably, each linear actuator is passive. In other words, each actuator is non-motorised. The chair can thereby be lightened and the chair bulk can be reduced relative to a motorised chair, for example by an electric motor. On the other hand, it may require a lighter maintenance than a motorised chair.

Preferably, each linear actuator comprises a cylinder.

More preferably, each linear actuator comprises a gas spring loaded type cylinder.

The gas spring loaded type linear actuator only partially assists the user to stand-up, remain standing and sit down. The intensity of the rising force of the movable base plate exerted by the actuator tends to vary less during the actuator stroke. The actuator may help the user to stand-up and sit down, while being particularly adapted to the reeducation in walking/maintaining of the user's walking ability.

According to a particular embodiment, the walking aid wheelchair comprises at least two first arms each extending between the chassis and the base plate, and two linear actuators which are each connected through a lower mechanical connection to the chassis and through an upper mechanical connection to one of the arms. The linear actuators may then be configured to bias the movable base plate to the high position through one of the first arms. The first arm each form a third class lever.

According to a particular embodiment, each first arm is connected at its lower end through a lower hinge to the chassis and at its upper end through an upper hinge to the movable base plate. The upper hinge is located behind the lower hinge over the entire stroke of the movable base plate when the movable base plate moves from the low position up to the high position.

Preferably, the upper mechanical connection of each linear actuator of one of the first arms is located behind the lower mechanical connection of this linear actuator, at least when the movable base plate is in the high position.

According to a particular embodiment, the walking aid wheelchair comprises at least one second arm which extends between the chassis and the movable base plate.

Preferably, the walking aid wheelchair comprises at least two second arms which each extend between the chassis and the movable base plate.

Preferably, each second arm is a follower arm which is movably driven with respect to the chassis by the at least one first arm.

Alternatively and preferably, the wheelchair further comprises a linear actuator by second arm, which is connected through a lower mechanical connection to the chassis and through an upper mechanical connection to this second arm. This linear actuator is configured to bias the movable base plate to the high position through the second arm.

According to a particular embodiment, the arms are substantially parallel to each other. For example, the segments formed by the centres of the hinges of each arm are parallel to each other.

According to a particular embodiment, the arms are laterally connected to the movable base plate, the position changing device is configured so that the user is between the arms, at least when the movable base plate is in the high walking position.

Preferably, the arms, the movable base plate and the chassis have a general parallelogram shape deformable between the high position and the low position.

According to a particular embodiment, the position changing device is configured to move the movable base plate relative to the chassis in a circumferential translational motion between the high walking position and the low sitting position.

Preferably, each first arm and/or each second arm is connected at its lower end through a pivot connection to the chassis and at its upper end through a pivot connection to the movable base plate.

The movable base plate tends to be better guided and to be more stable relative to the chassis. The user can more readily interact with his/her environment, in particular forward. He/she can come in and/or out more readily in his/her chair.

Preferably, the lower end and/or the upper end of each first arm is configured to form an angle between 50° and 90° with the horizontal counterclockwise, of preferably at most 76° when the movable base plate is in the high walking position.

Preferably, the lower mechanical connection and the upper mechanical connection are pivot connections.

According to a particular embodiment, the upper mechanical connection of each linear actuator is located behind the lower mechanical connection of the linear actuator, when the movable base plate is in at least one position between the high position and the low position, in particular at least when the movable base plate is in the high position.

The upward rearward tilt of each actuator tends for example to move the chair further closer to the user upon lowering the movable base plate, and to decrease the weight to be exerted onto the movable base plate to move it to the low sitting position, relative to an actuator which would be upward forward tilted.

Advantageously, the absolute value of the angle between each linear actuator and the normal to the corresponding arm in the low position is lower than the absolute value of the angle between this linear actuator and the normal to the corresponding arm in the high position.

According to a particular embodiment, the movable base plate comprises two side support elements and an intermediate support element laterally located between both side support elements, each of the side support elements forms with the intermediate support element a housing for one of the user's lower limbs in the high position.

According to a particular embodiment, the movable base plate comprises a saddle.

Preferably, the movable base plate comprises a saddle base to which the saddle is configured to be detachably connected.

According to a particular embodiment, the saddle has a laterally adjustable position relative to the chassis.

According to a particular embodiment, the wheelchair comprises a lower abutment member configured to be a rear abutment for part of the user's lower limb at least in the low sitting position. The lower abutment member is located in front of the saddle and it is at least partly laterally adjustable relative to the chassis.

Preferably, the lower abutment member comprises a fitting which is laterally adjustable relative to the chassis.

According to a particular embodiment, the movable base plate comprises a frame to which the saddle is connected by being tiltable at least along the height direction.

According to a particular embodiment, the chassis comprises at least two slender posts and a fixed base. The slender posts may extend at least partially from front to rear. The arms and the linear actuators may be connected to the slender posts. The fixed base may extend between both slender posts along a transverse direction of the wheelchair, by mechanically connecting the slender posts to each other. The movable base plate may be configured to abut against the fixed base in the low sitting position.

Preferably, the slender posts are rectilinear.

Preferably, each of the slender posts comprises at least one bar.

Preferably, the chassis comprises a backrest which is rigidly integral with the fixed base and which extends upward from the fixed base.

Alternatively and preferably, the wheelchair comprises a backrest which is rigidly integral with the movable base plate.

According to a particular embodiment, the walking aid wheelchair comprises a front retaining member configured to retain the user from moving forward relative to the chassis.

According to a particular embodiment, the front retaining member comprises a front abutment element configured to abut against the user's pelvis in the high position.

Preferably, the front abutment element is an iliac abutment configured to abut against the user's anterior-superior iliac spine.

According to a particular embodiment, the front retaining member is configured to guide the wheelchair, at least when the movable base plate is in the high walking position.

Preferably, the front retaining member comprises the front abutment element and a base. The front abutment element is in particular configured to be able to pivot relative to the base between an upper position and a lower position. More preferably, the front abutment element is configured to pivot relative to the base between an upper position when the movable base plate is in the low position, and a lower position when the movable base plate is in the high position.

Preferably, the front retaining member comprises a support arm to which the front abutment element is connected by a hinge.

Preferably, the front abutment element is laterally movable between an open position in which the front abutment element lets the user sit down on the movable base plate and a closed position in which it retains the user from moving forward relative to the movable base plate.

According to a particular embodiment, the walking aid wheelchair comprises a push rear member which is movably connected to the movable base plate.

According to a particular embodiment, the push rear member comprises at least one rear abutment element to abut against the rear of one of the user's lower limbs in the high position, and the push rear member comprises a return means configured to bias the rear abutment element forward.

Preferably, the rear abutment element is pivotable relative to the movable base plate.

More preferably, the rear abutment element is configured to have an oscillating motion relative to the movable base plate while accompanying the lower limb in walking.

According to a particular embodiment, the push rear member is configured to face one of the housings of the movable base plate in the high walking position. The push rear member is configured to seal at least partially the housing in the low sitting position.

According to another particular embodiment, the push rear member is configured to be in front of the saddle, by abutting against the rear of the user's lower limbs in the low sitting position.

According to a particular embodiment, the walking aid wheelchair comprises a member for locking the movable base plate in the low sitting position and/or in the high walking position.

Preferably, the locking member comprises at least one locking bar pivotably connected relative to the chassis and at least one locking pin which is integral with the movable base plate. The locking bar may engage the locking pin in the locking position.

More preferably, the locking member comprises two locking bars each pivotably connected relative to the chassis and two locking pins which are each integral with the movable base plate. Each locking bar may engage one of the locking pins in the locking position.

BRIEF DESCRIPTION OF THE DRAWINGS

The present invention will be better understood upon reading the description of exemplary embodiments, given by way of purely indicating and in no way limiting purposes, with reference to the appended drawings in which.

DETAILED DISCLOSURE OF PARTICULAR EMBODIMENTS

Figure 1:
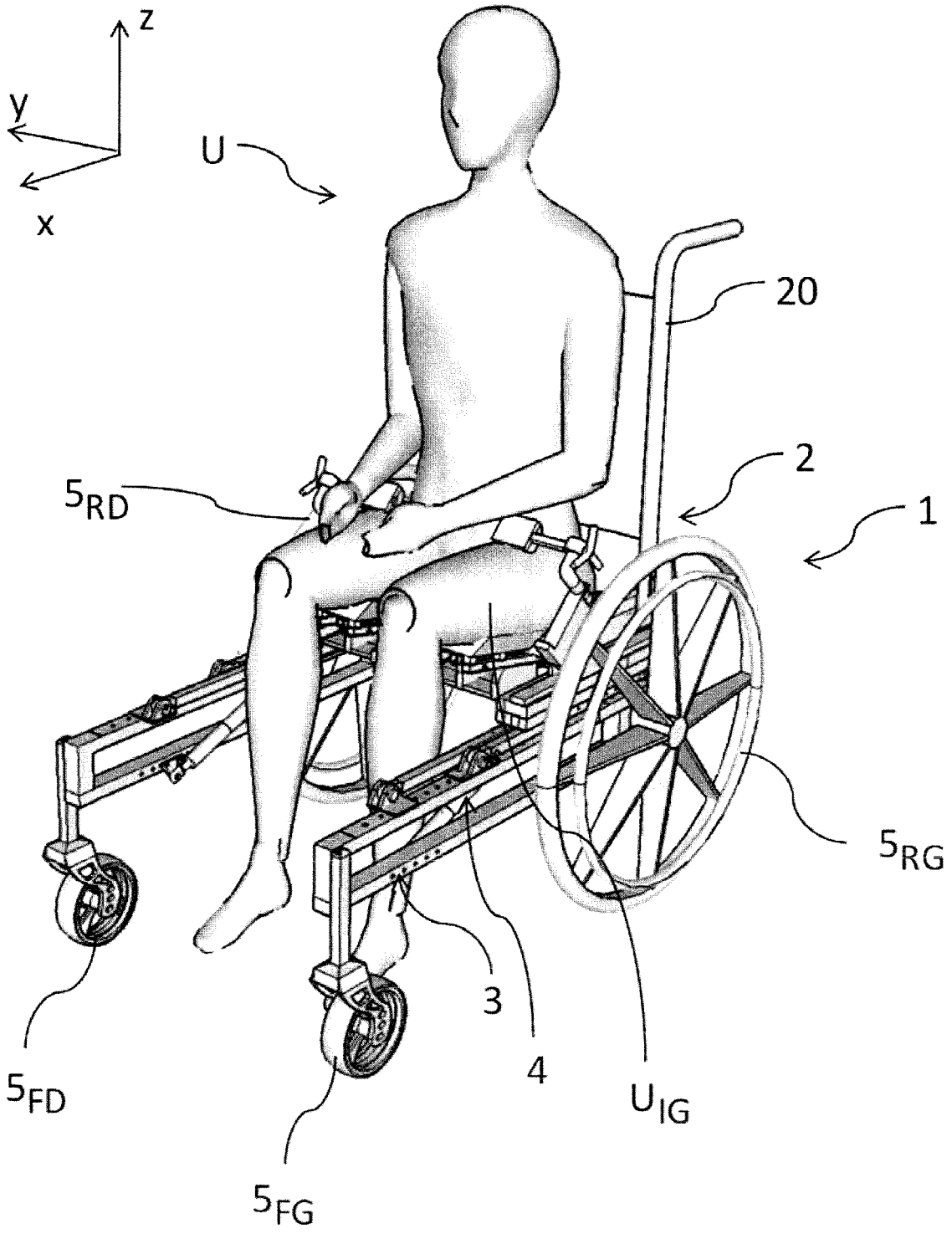
FIG. 1 is a perspective partial schematic representation of a walking aid wheelchair, according to a first embodiment of the invention, in which the movable base plate is in the low sitting position.

Identical, similar or equivalent parts of the different figures bear the same reference numerals so as to facilitate switching from one figure to the other.

FIGS. 1 to 9 represent a walking aid wheelchair 1 according to a first embodiment. The walking aid wheelchair 1 comprises a seat 2 which includes a movable base plate 60. The wheelchair 1 also comprises a chassis 3, two rear wheels $\mathbf{5}_{RG}$ and $\mathbf{5}_{RD}$, two front wheels $\mathbf{5}_{FG}$ and $\mathbf{5}_{FD}$, and a position changing device 4 for the base plate.

The chair 1 extends along a front-rear longitudinal direction X-X. The front of the chair corresponds to the front of the user in FIG. 1. The rear of the chair corresponds to the rear of the user U when he/she is sits on the chair 1.

The chair 1 also extends along a left-right transverse direction Y-Y. The left and right senses respectively correspond to the left and to the right of the user U when he/she sits in the chair 1.

Finally, the chair 1 also extends along a height direction Z-Z. The high and low senses respectively correspond to those for the user U when he/she sits in the chair 1.

The seat 2 includes a backrest 20 which is attached to the chassis 3, and a movable seat assembly 6 of which the movable base plate 60 is part. The movable seat assembly 6 is movable with respect to the chassis 3 and will be described in detail hereinafter.

Figure 2:
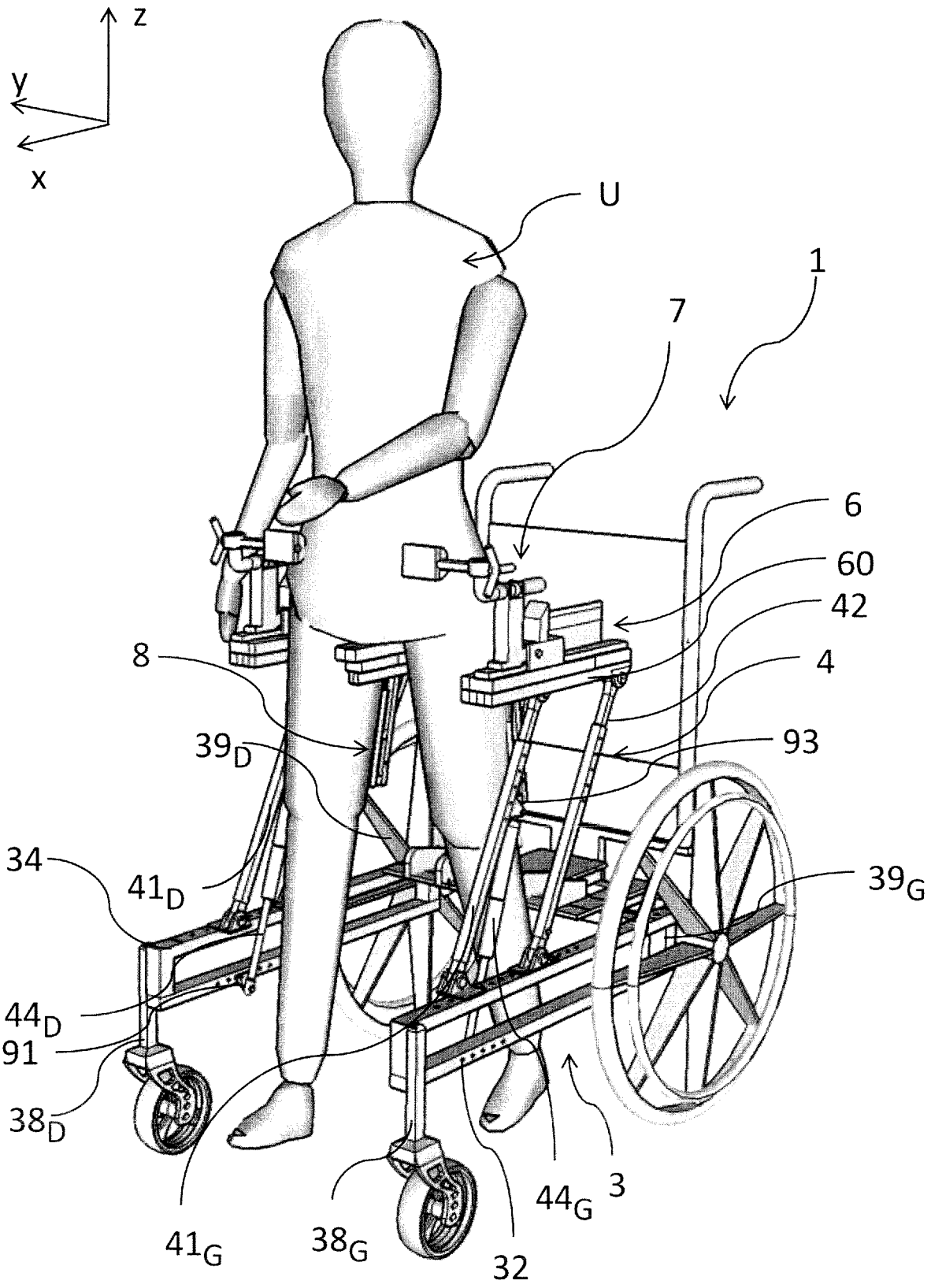
FIG. 2 is a perspective partial schematic representation of the walking aid wheelchair, wherein the base plate is in the high walking position.

The movable base plate 60 is movable with respect to the chassis 3 between a low sitting position which is represented in FIG. 1 and a high walking position which is represented in FIG. 2. In the low sitting position, a user U can sit down on the movable base plate 60. In the high walking position, the movable base plate 60 is in contact with the user U and mostly behind the user U.

The left $\mathbf{5}_{RG}$ and right $\mathbf{5}_{RD}$ rear wheels are large-size wheels, conventional for a wheelchair 1. The left $\mathbf{5}_{FG}$ and right $\mathbf{5}_{FD}$ front wheels are of a smaller size. Among other things, they are used to steer the wheelchair 1. They can in particular pivot relative to the chassis 3, to enable the user U to more readily steer the wheelchair 1.

The wheelchair 1 is a walking aid wheelchair in that it is to configured to help a mobility impaired person to stand-up and walk as normally as possible.

Figure 3:
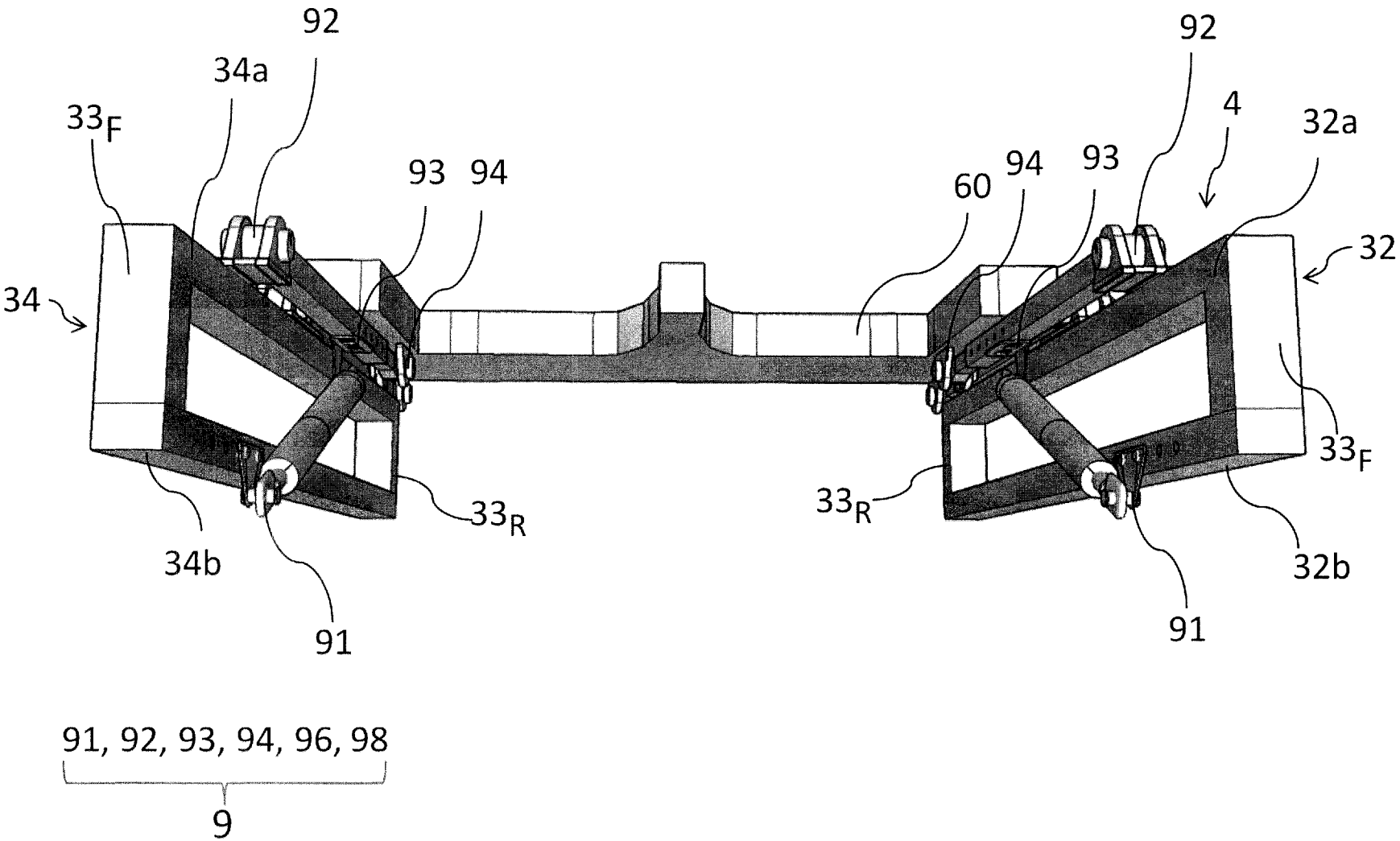
FIG. 3 is a perspective partial schematic representation of the movable base plate and of the position changing device of the wheelchair when the base plate is in the low sitting position.
Figure 4:
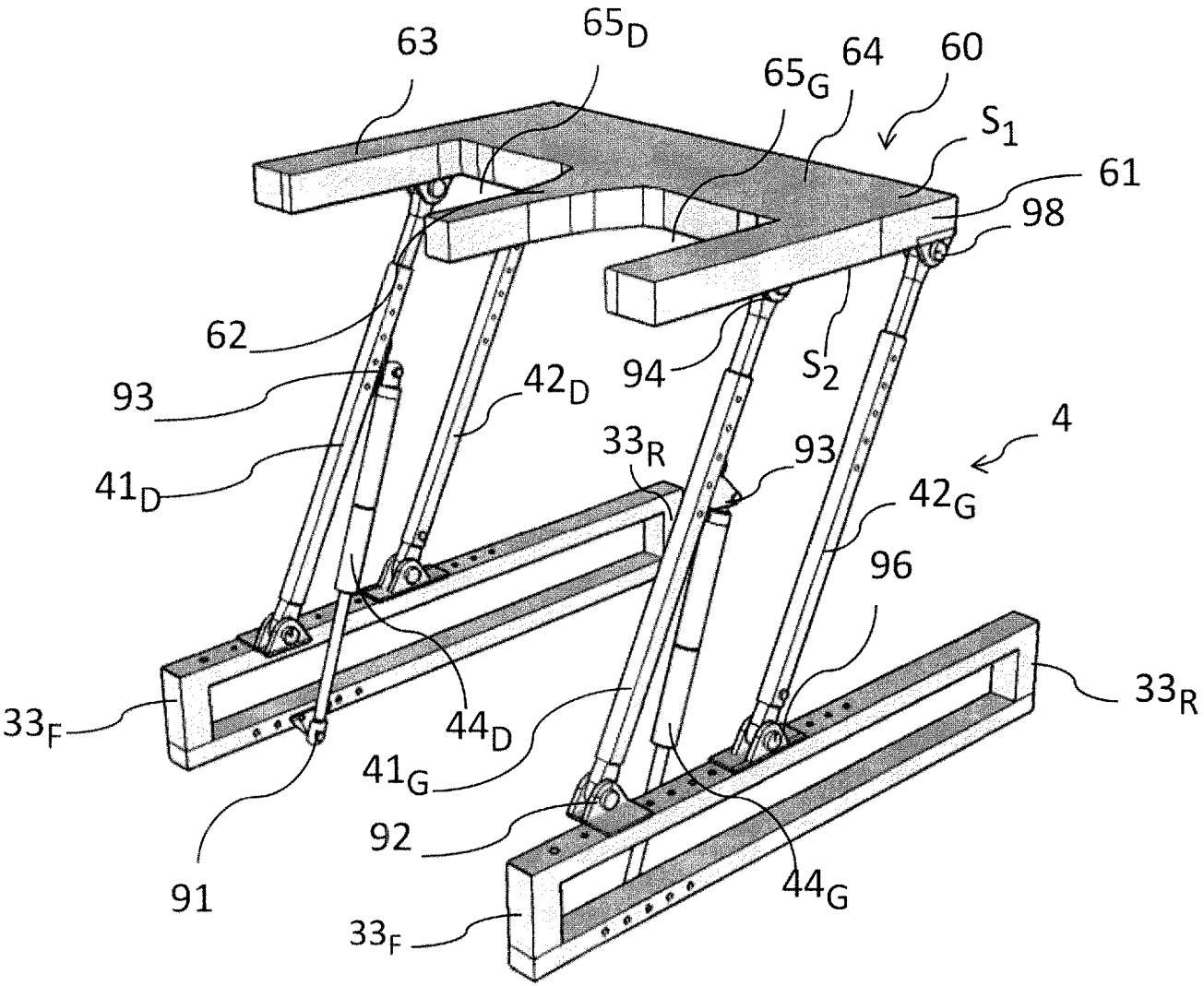
FIG. 4 is a perspective partial schematic representation of the movable base plate and the position changing device of the wheelchair when the base plate is in the high walking position.

With reference more specifically to FIGS. 2 to 4, the chassis 3 comprises at least two slender posts 32, 34, front wheel supports $\mathbf{38}_G$, $\mathbf{38}_D$, rear wheel supports $\mathbf{39}_G$, $\mathbf{39}_D$ and a fixed base 36.

The slender posts 32, 34 are rectilinear and they each extend along the longitudinal direction X-X from front to rear, by being spaced from each other along the transverse direction Y-Y and by being substantially parallel to each other.

One of the posts 32, 34 is a left post 32. The other of the posts 32, 34 is a right post 34.

Each of the slender posts 32, 34 comprises a support upper bar 32*a*, 34*a* and a support lower bar 32*b*, 34*b*. The lower bar 32*b*, 34*b* is parallel to the corresponding upper bar 32*a*, 34*a* and above the same.

The lower bar 32*b*, 34*b* is mechanically connected to the corresponding upper bar 32*a*, 34*a* by two front 33F and rear 33R parallel bars. These front 33F and rear 33R parallel bars each extend vertically along the height direction Z-Z and are each substantially located at one of the longitudinal ends of the upper bar 32*a*, 34*a*.

The front wheel supports 38G, 38D are attached to the front bars. The rear wheel supports 39G, 39D are attached to the rear bars.

Figure 9:
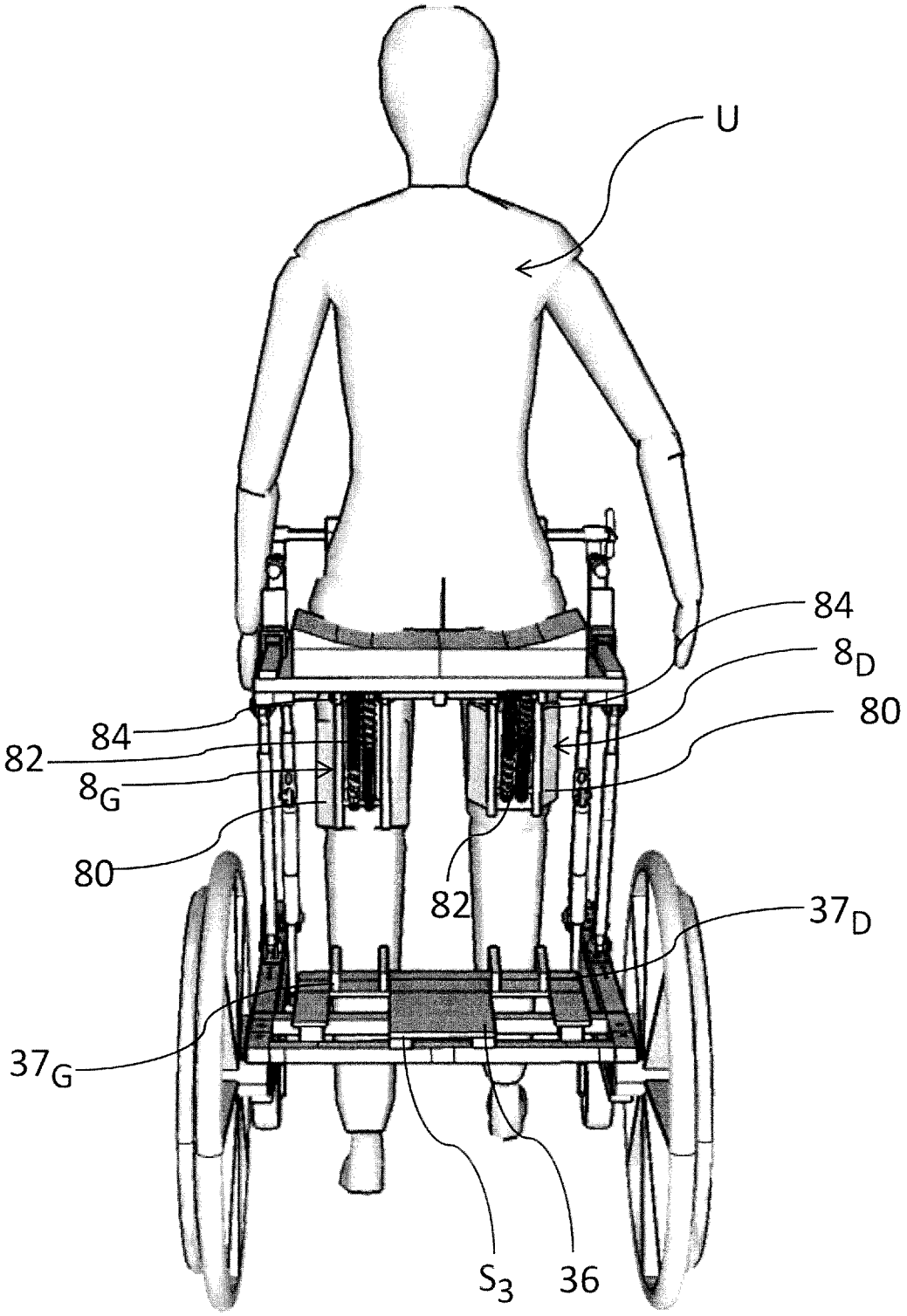
FIG. 9 is a rear view partial schematic representation of the walking aid wheelchair, in which the base plate is in the intermediate position.

With reference more specifically to FIG. 9, the fixed base 36 extends between both slender posts 32, 34 along a transverse direction Y-Y of the wheelchair 1, by mechanically connecting both slender posts 32, 34 to each other.

The backrest 20 is not represented in FIG. 9, for the sake of legibility.

The fixed base 36 has a general plate shape the upper surface S3 of which is facing the lower surface S2 of the movable base plate 60. It comprises two left and right housing rims 37G, 37D for housing front push members 8 which are part of the movable seat assembly 6.

The fixed base 36 acts as a pedestal for the movable seat assembly 6, in particular for the base plate 60 in its low sitting position.

The backrest 20 is rigidly integral with the fixed base 36 and it extends upward from the fixed base 36.

With reference to FIGS. 1 to 5, the position changing device 4 comprises two first left $\mathbf{41}_G$, and right $\mathbf{41}_D$ arms, two left $\mathbf{44}_G$ and right $\mathbf{44}_D$ linear actuators, two left $\mathbf{42}_G$ and right $\mathbf{42}_D$ second arms, and a hinge assembly 9.

The arms $\mathbf{41}_G$, $\mathbf{41}_D$, $\mathbf{42}_G$, $\mathbf{42}_D$, the movable base plate 60 and the chassis 3 form together a deformable parallelogram which deforms, because of the hinge assembly 9, between the high walking position and the low sitting position.

The lower end and the upper end of each first arm 41G, 41D and of each second arm 42G, 42D is configured to form an angle between 50° and 90° with the horizontal counter-clockwise. The lower end and the upper end of each first arm $\mathbf{41}_G$, $\mathbf{41}_D$ and of each second arm $\mathbf{42}_G$, $\mathbf{42}_D$ is in particular configured to form an angle of at most 76° with the horizontal in the high walking position. In the first embodiment, the lower end and the upper end of each first arm $\mathbf{41}_G$, $\mathbf{41}_D$ and of each second arm $\mathbf{42}_G$, $\mathbf{42}_D$ form an angle of about 67.5° with the horizontal.

The position changing device 4 is configured to move the base plate 60 with respect to the chassis 3 between the high walking position and the low sitting position. It moves the movable base plate 60 with respect to the chassis 3 in a circumferential translational motion between the high walking position and the low sitting position.

The first arms $41_G$, $41_D$ each extend between the chassis 3 and the base plate 60. Each first arm $41_G$, $41_D$ is connected at its lower end through a lower hinge 92 to one of the upper bars 32*a*, 34*a*. It is connected at its upper end through an upper hinge 94 to the movable base plate 60, for example under the base plate 60. The first arms $41_G$, $41_D$ are parallel to each other.

Each of the first arms $41_G$, $41_D$ forms an effort in the middle-type lever, also called third class lever, which is actuated by one of the linear actuators $44_G$, $44_D$. The second arms $42_G$, $42_D$ each extend between the chassis 3 and the movable base plate 60. Each second arm $42_G$, $42_D$ is connected at its lower end through a lower hinge 96 to one of the upper bars 32*a*, 34*a*. Each second arm $42_G$, $42_D$ is connected at its upper end through an upper hinge 98 to the movable base plate 60, for example under the base plate 60.

The second arms $42_G$, $42_D$ are located behind the first arms $41_G$, $41_D$, by being substantially parallel to the first arms $41_G$, $41_D$. More precisely, the axis of the hinges 92, 94 of the second arms are parallel to the axes of the hinges 96, 98 of the first arms. The second arms $42_G$, $42_D$ are parallel to each other.

Each second arm $42_G$, $42_D$ is a follower arm which is movably driven with respect to the chassis 3 by one of the first arms $41_G$, $41_D$.

The linear actuators $44_G$, $44_D$ are each passive linear actuators $44_G$, $44_D$, that is non-motorised linear actuators. By motor, it is meant a system controllably transforming a non-mechanical energy such as an electric energy into a mechanical energy or work.

Each of the linear actuators $44_G$, $44_D$ comprises a cylinder.

The linear actuators $44_G$, $44_D$ are each connected through a lower mechanical connection 91 to one of the lower bars 32*b*, 34*b* and through an upper mechanical connection 93 to one of the first arms $41_G$, $41_D$. The upper mechanical connection 93 is located substantially in the middle of the corresponding first arm $41_G$, $41_D$.

Each of the linear actuators $44_G$, $44_D$ is configured to bias the movable base plate 60 to the high walking position through one of the first arms $41_G$, $41_D$. They enable the position changing device 4 to partially support the user U's weight upon switching from the low position to the high position, while allowing switching from the high position to the low position using the user U's weight.

The hinge assembly 9 comprises the lower mechanical connection 91, the upper mechanical connection 93, the lower hinges 92 of the first arms, the lower hinges 96 of the second arms, the upper hinges 94 of the first arms, the upper hinges 98 of the second arms.

The lower hinges 92 of the first arms and the upper hinges 94 of the first arms are pivot connections. The lower hinges 92 of the first arms are in front of the upper hinges 94 of the first arms, whatever the position of the movable base plate 60 with respect to the chassis 3.

In other words, the first arms $41_G$, $41_D$ are tilted upward rearward. The movement of the movable base plate 60 upon switching from the low sitting position to the high walking position is made with a motion relative to the chassis 3 which is upward forward, to better reproduce the U's user natural motion to stand-up. By way of example, the distance ratio between the forward movement of the U's user pelvis and the height increase of the U's user pelvis when he/she accompanies the movable base plate 60 in his/her movement between his/her low sitting position and his/her high walking position is about 4/5. On the other hand, the movable base plate 60 will tend to move rearward with respect to the chassis 3 when it lowers under the effect of the U's user weight which is exerted thereon. In other words, the tilt of the first arms 41G, 41D tends to move forward the chassis 3 relatively to the user when the movable base plate 60 moves from its high walking position to its low sitting position.

The lower mechanical connection 91 of each first linear actuator $44_G$, $44_D$ and the upper mechanical connection 93 of each first linear actuator $44_G$, $44_D$ are pivot connections. Each first linear actuator $44_G$, $44_D$ has a smaller angle with respect to the normal of the first arm $41_G$, $41_D$ to which it is connected by the upper mechanical connection 93, in the proximity of the upper mechanical connection 93, when the movable base plate 60 is close to its low sitting position than when the movable base plate 60 is close to its high walking position.

For that reason, each first linear actuator $44_G$, $44_D$ tends to exert a higher push force on the first arm $41_G$, $41_D$, when the movable base plate 60 is close to its low sitting position than when the movable base plate 60 is close to its high walking position. The weight the user U exerts on the movable base plate 60 to sit down thus remains moderate with respect to the upward bias force of the base plate 60 by each first linear actuator $44_G$, $44_D$. This upward bias of each actuator $44_G$, $44_D$ thus does not block the user in the high position. The user U can thereby lower himself/herself under the effect of his/her weight without the risk of moving rearward, when he/she tends to sit down in the chair 1 or to fall vertically or rearward.

The upper mechanical connection 93 of each first linear actuator $44_G$, $44_D$ is located behind the lower mechanical connection 91 of each first linear actuator $44_G$, $44_D$, over at least most of the stroke of the movable base plate 60 when it moves with respect to the chassis 3 between the high position and the low sitting position. The tilt of each first linear actuator $44_G$, $44_D$ is determined in particular for dimensioning reasons. The lever arm exerted by each linear actuator $44_G$, $44_D$ on the first arm $41_G$, $41_D$ is thereby satisfactory. Moreover, the lower hinge 91 of each actuator $44_G$, $44_D$ is not too low relative to the chassis 3.

The lower hinges 96 of the second arms and the upper hinges 98 of the second arms are pivot connections. The lower hinges 96 of the second arms are in front of the upper hinges 98 of the second arms, whatever the position of the movable base plate 60 with respect to the chassis.

In other words, the second arms $42_G$, $42_D$ are tilted upward rearward. The movement of the movable base plate 60 upon switching from the low sitting position to the high walking position is made with a motion relative to the chassis 3 which is upward forward, to better reproduce the U's user natural movement to stand-up. On the other hand, the movable base plate 60 will tend to move rearward with respect to the chassis 3 when it lowers under the effect of the U's user weight which is exerted thereon. In other words, the tilt of the second arms $42_G$, $42_D$ tends to move the chassis 3 forward relative to the user when the movable base plate 60 moves from its high walking position to its low sitting position.

The lower hinges 96 of the second arms are behind the corresponding lower hinges 92 of the first arms. The lower hinges 96 of the second arms are in front of the corresponding upper hinges 94 of the first arms, when the movable base plate 60 is in the low sitting position.

The upper hinges 98 of the second arms are behind the upper hinges 94 of the first arms.

The movable seat assembly 6 comprises the movable base plate 60, two left $7_G$ and right $7_D$ front retaining members, and two left $8_G$ and right $8_D$ push rear members.

The front retaining members $7_G$, $7_D$ and the push rear members $8_G$, $8_D$ are each mechanically movably connected relative to the movable base plate 60 they accompany in its movement relative to the chassis 3 between its low sitting position and its high walking position.

The movable base plate 60 comprises an upper surface $S_1$ and a lower surface $S_2$ which is opposite the upper surface $S_1$. The lower surface $S_2$ abuts against the upper surface $S_3$ of the fixed base, in the low sitting position. It is facing the upper surface $S_3$ of the fixed base, in the high walking position.

The movable base plate 60 comprises two left 61 and right 63 side support elements, an intermediate support element 62 and a rear support element 64. The movable base plate 60 is circumferentially translationally movable relative to the chassis 3 between the low sitting position and the high walking position.

The left side support element 61 forms together with the intermediate support element 62 a housing $65_G$ for the user's left lower limb $U_{IG}$ in the high position. This housing $65_G$ is at least partially sealed in the low sitting position.

The right side support element 63 forms together with the intermediate support element 62 a housing $65_D$ for the user's right lower limb $U_{ID}$ in the high position. This housing $65_D$ is at least partially sealed in the low sitting position.

The intermediate support element 62 is located laterally between both side support elements 61, 63. It is substantially in the centre of the movable base plate 60 along the transverse direction Y-Y and serves in particular as a saddle.

The rear support element 64 acts as a support for the U's user buttocks in the low sitting position. It is located behind the user U in the high walking position, by delimiting the rear of each of the housings $65_G$, $65_D$.

Figure 7:
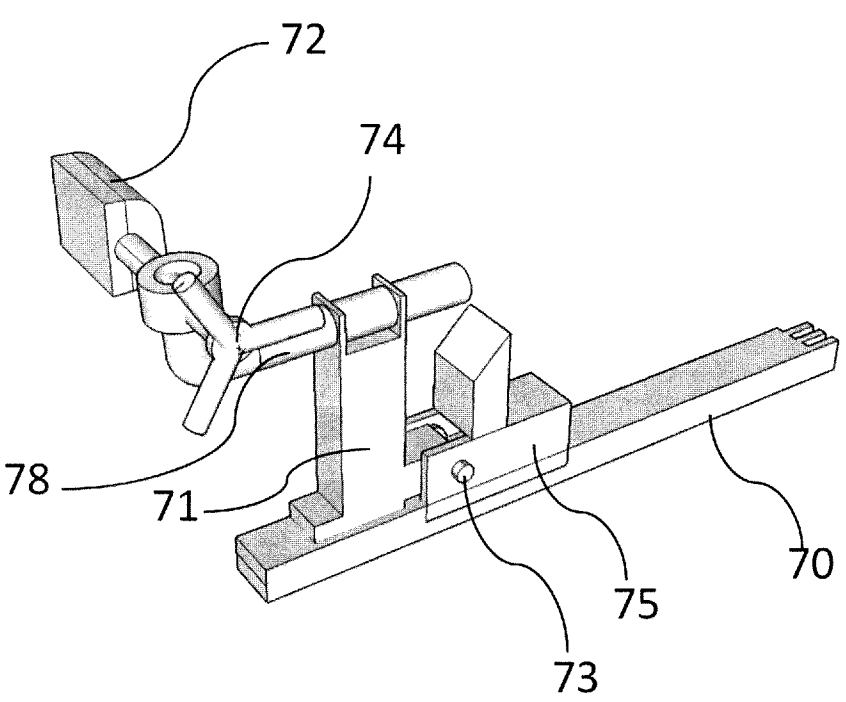
FIG. 7 is a perspective partial schematic representation of a front retaining member of the wheelchair, in the high walking position.
Figure 6:
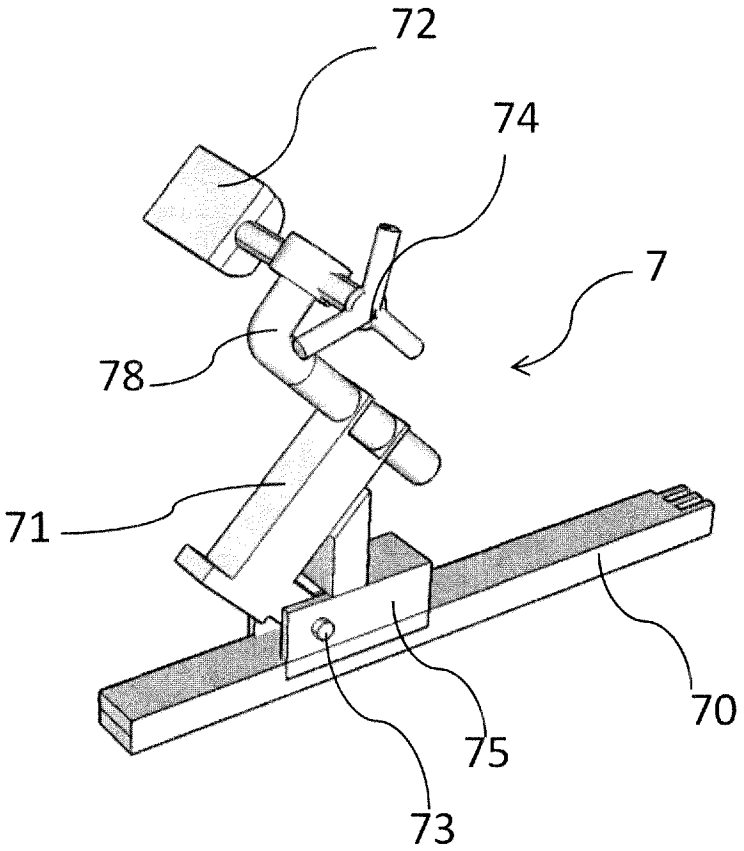
FIG. 6 is a perspective partial schematic representation of a front retaining member of the wheelchair, in the low sitting position.

With reference to FIGS. 6 and 7, each front retaining member $7_G$, $7_D$ comprises a base 70, a movable mount 71, a front abutment element 72, an arm 78, a hinge 73, an adjustment member 74 and a stop 75.

The front retaining members $7_G$, $7_D$ are each configured to retain the user U from going forward relative to the chassis 3. They may also enable the user U to drive the wheelchair 1.

The base 70 is to be fixedly assembled to the movable base plate 60, in particular at one of the side support elements 61, 63 against which it abuts. It is preferably mechanically detachably connected to the movable base plate 60, which makes the retaining member $7_G$, $7_D$ removable. It acts as a support for the front abutment element 72.

The arm 78 connects the front abutment element 72 to the movable mount 71. The movable mount 71 connects the arm 78 to the hinge 73.

The front abutment element 72 is an iliac abutment. It is configured to abut against the U's user anterior superior iliac spine, in the high walking position. It enables the user U to drive the wheelchair 1, without needing his/her hands. It is also configured to be in the proximity of the U's user anterior superior iliac spine, in the low sitting position to retain him/her in the chair 1.

Each front abutment element 72 is configured to move relative to the base 70 between a rear position when the base plate is in the low sitting position, and a front position when the movable base plate 60 is in the high walking position.

The hinge 73 comprises a rod and a torsion spring which biases the front abutment element 72 to its rear position. It forms a pivot connection. It is configured to pivot the front abutment element 72 relative to the base 70 between the rear upper position, which is represented in FIG. 6 and the front lower position which is represented in FIG. 7.

The adjustment member 74 is adjustable in height, in depth and laterally. It is configured to adjust the position of the front abutment element 72 relative to the base 70, such that the front abutment element 72 abuts against the U's user anterior superior iliac spine in the high walking position.

The stop 75 is a rear stop. It limits the pivoting amplitude of the front abutment element 72, when it is moved rearward relative to the base 70.

Figure 5:
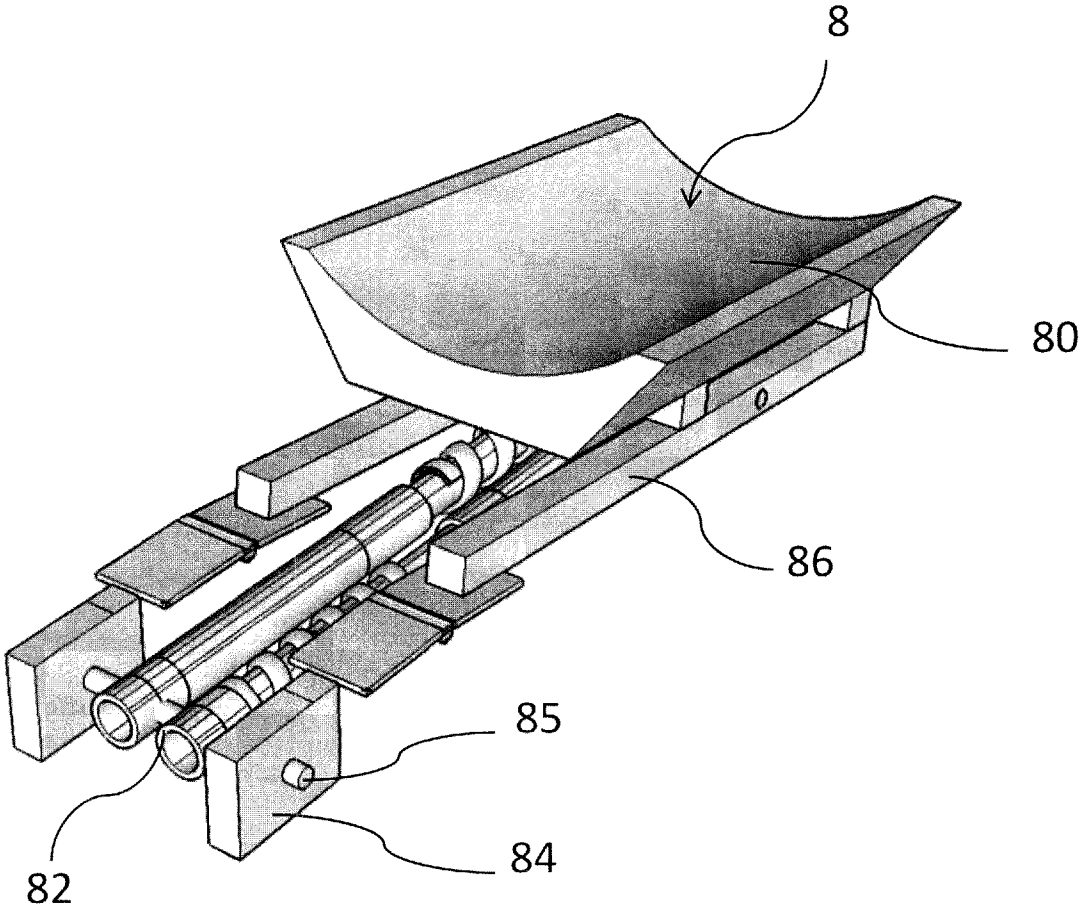
FIG. 5 is a perspective partial schematic representation of a push rear member of the wheelchair.

With reference to FIGS. 5 and 9, each push rear member 8 comprises a rear abutment element 80, a support arm 86, a return means 82, a support 84 and a connection member 85.

Each push rear member 8 is configured to face one of the housings $65_G$, $65_D$ of the movable base plate 60 in the high walking position. Each push rear member 8 is configured to seal at least partially the housing $65_G$, $65_D$ in the low sitting position. The push rear members $8_G$, $8_D$ are each configured to bias one of the U's user lower limbs $U_{ID}$, $U_{IG}$ forward during walking. For that reason, the U's user walk is made easier, which is all the more interesting with regard to the bulk and mass of the wheelchair 1.

The rear abutment element 80 has a concave shape which is meant perfectly fit the shape of the user's lower limb $U_{ID}$, $U_{IG}$, in particular of the U's user thigh against which the rear abutment element 80 abuts in the high position and in the low position.

The rear abutment element 80 raises in the housing $65_G$, $65_D$ in the low sitting position, to seal it at least partially and by being in its housing 37 of the fixed base 36. The seat formed by the rear abutment elements 80 and the movable base plate 60 is thereby more comfortable in the low sitting position.

The rear abutment element 80 is pivotable relative to the movable base plate 60, by being configured to have an oscillating motion along the longitudinal direction X-X relative to the movable base plate 60, by accompanying the lower limb $U_{ID}$, $U_{IG}$ during walking.

The return means 82 is made as a spring, for example a helical spring. It is configured to bias the rear abutment element 80 forward, which makes it easier for the user U to walk. The user U counters the return force of each return means 82, in particular thanks to his/her weight, when the lower limb which is on the ground moves rearward upon walking relative to the other of the lower limbs.

The support 84 is attached to the lower surface $S_3$ of the movable base plate 60. The connection member 85 comprises a rod. This is a pivot connection configured to pivot the rear abutment element 80 forward relative to the movable base plate 60.

The support arm 86 connects the rear abutment element 80 to the support 84. It is configured to pivot about the connection member 85.

Switching from the low sitting position to the high walking position is described below with reference to FIGS. 1, 8 and 2 successively.

In FIG. 1, the user U sits in the wheelchair 1, the movable base plate 60 is in the low sitting position. The position changing device 4 is in its folded position which is represented in FIG. 3. The backrest 20 prevents the user U from falling rearward. The front retaining elements 7 prevent the user U from falling forward.

Figure 8:
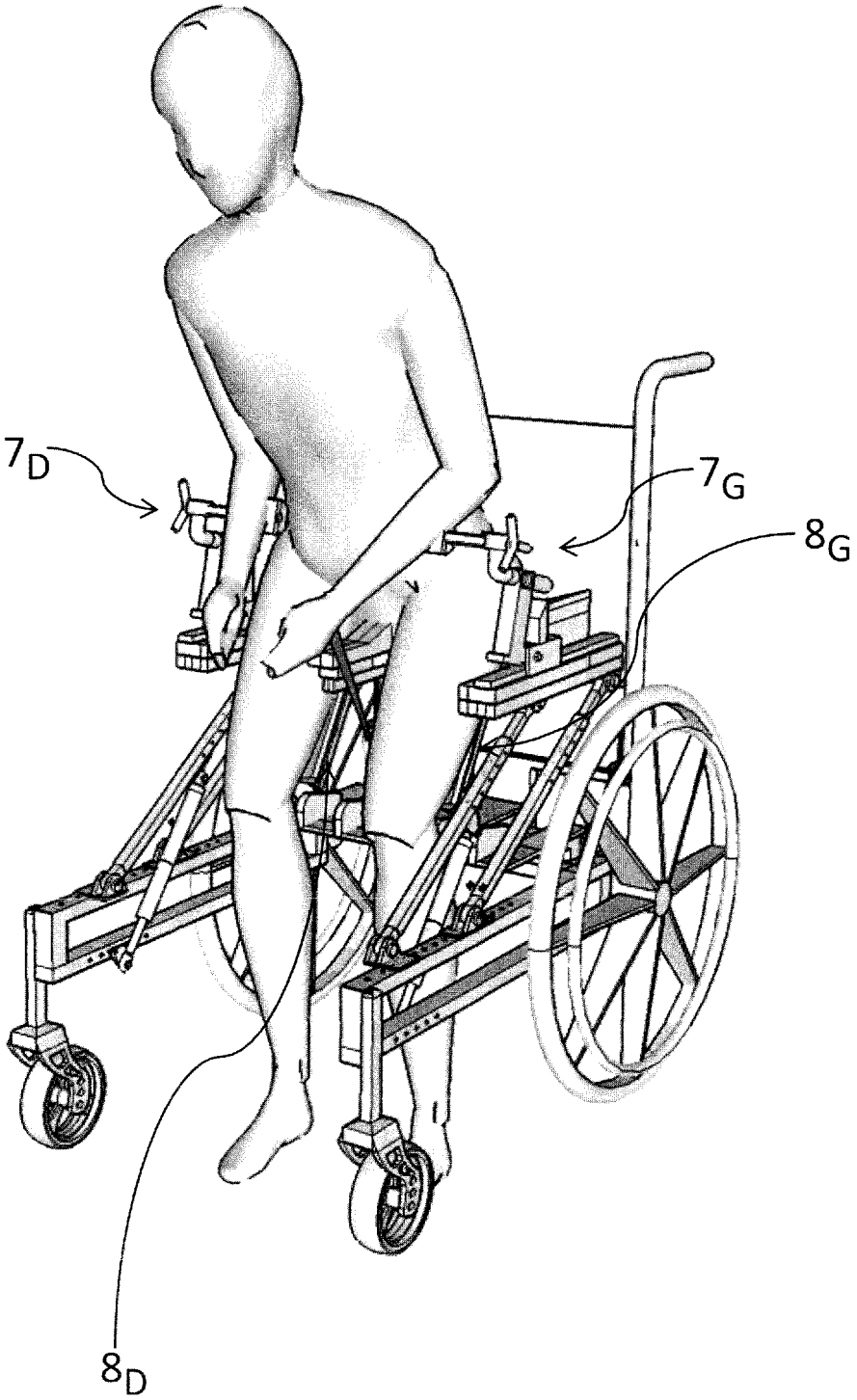
FIG. 8 is a perspective partial schematic representation of the walking aid wheelchair, in which the base plate is in the intermediate position between the low position and the high position.

In FIG. 8, the user U is standing-up from the wheelchair 1, the movable base plate 60 lifts between the low sitting position and the high walking position, by accompanying the U's user movement. The position changing device 4 is in an intermediate position between its folded position which is represented in FIG. 3 and its deployed position which is represented in FIG. 4. The linear actuators $\mathbf{44}_D$, $\mathbf{44}_G$ bias the movable base plate 60 to its high walking position.

The bias push of the linear actuators $\mathbf{44}_D$, $\mathbf{44}_G$ is highest in the low sitting position, it gradually decreases as the angle at the normal to the arm of each actuator $\mathbf{44}_D$, $\mathbf{44}_G$ increases upon lifting the movable base plate. Conversely, the arms $\mathbf{41}_D$, $\mathbf{41}_G$, $\mathbf{42}_D$, $\mathbf{42}_G$ support an increasingly high a tangential force of the user's weight as the movable base plate 60 lifts to the high walking position. The position changing device 4 partially catches again the U's user weight over the entire lift stroke of the movable base plate 60. Thus, it helps the user U to stand-up and remain standing. The front retaining elements 7 prevent the user U from falling forward.

In FIG. 2, the user U is standing. The user's weight is partially supported by the position changing device 4 which helps the user U to remain in the standing position. His/her right $U_{ID}$ and left $U_{IG}$ lower limbs are located in the corresponding housings $\mathbf{65}_D$, $\mathbf{65}_G$. The movable base plate 60 is in the high walking position. The position changing device 4 is in its deployed position which is represented in FIG. 4. The front retaining elements 7 prevent the user U from falling forward.

With reference to FIG. 2, the front retaining elements 7 prevent the user U from falling forward. They also enable him/her to walk by driving the wheelchair 1 with him/her, while he/she has his/her hands free.

The walking aid wheelchair 1 according to the second embodiment is represented with reference to FIGS. 10 to 25.

The walking aid wheelchair 1 according to the second embodiment is mainly different from that according to the first embodiment because of the structures of its movable base plate 60 and of its lifting device 4.

Figure 19:
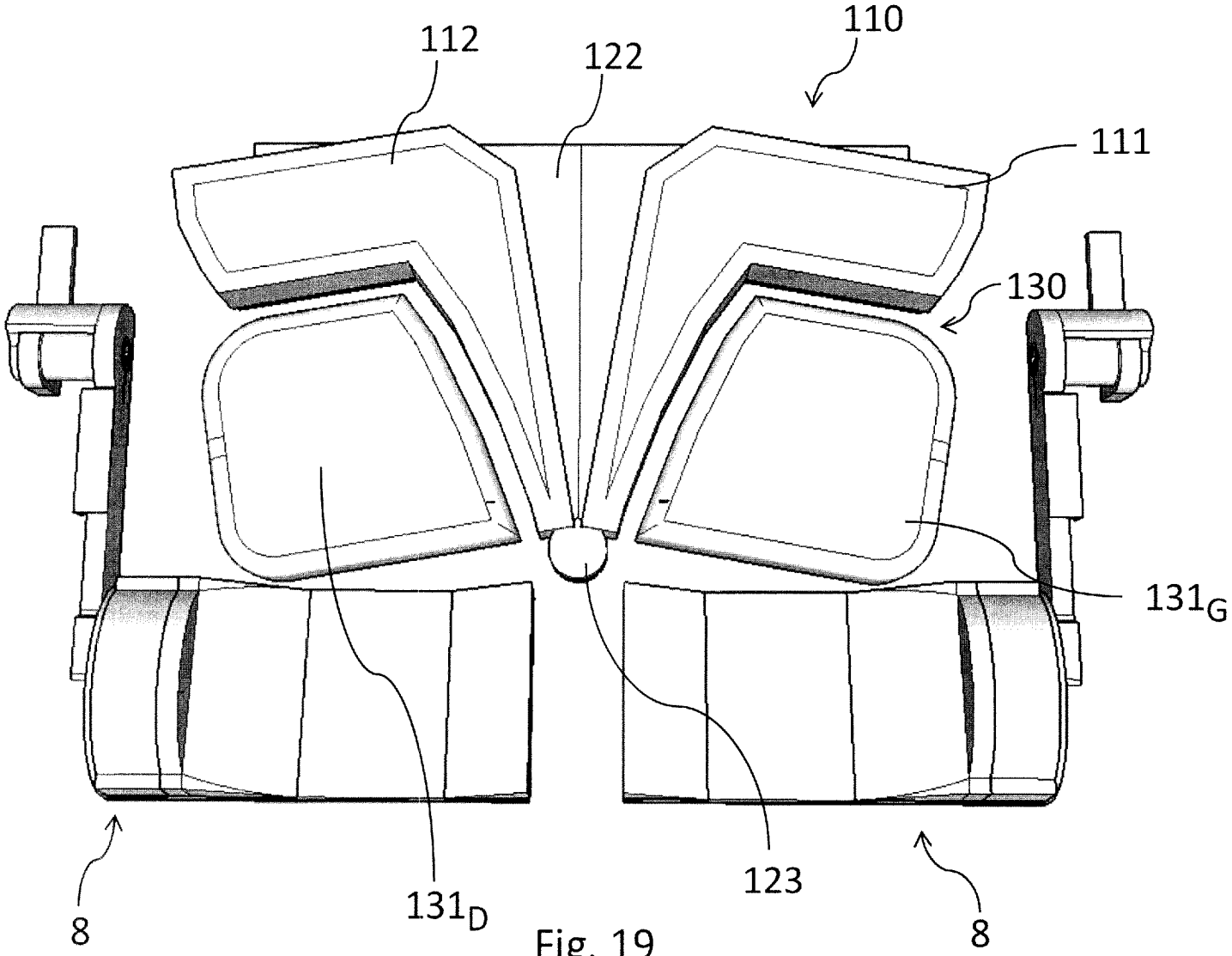
Figure 20:
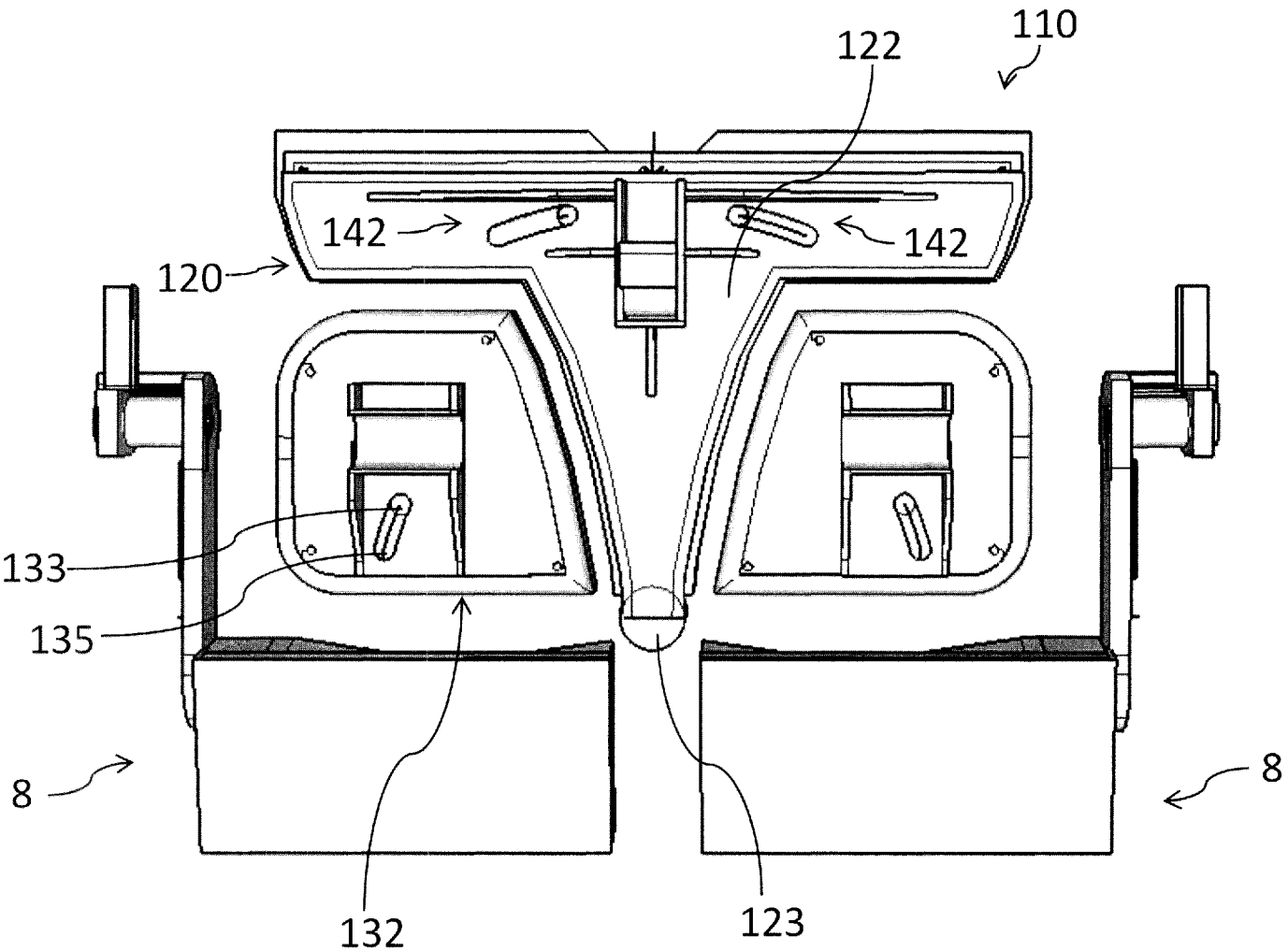
FIG. 20 and FIG. 21 are bottom view partial schematic representations of the adjustable seat of the walking aid wheelchair, in two positions distinct by the side position of the saddle and of the lower abutments.
Figure 21:
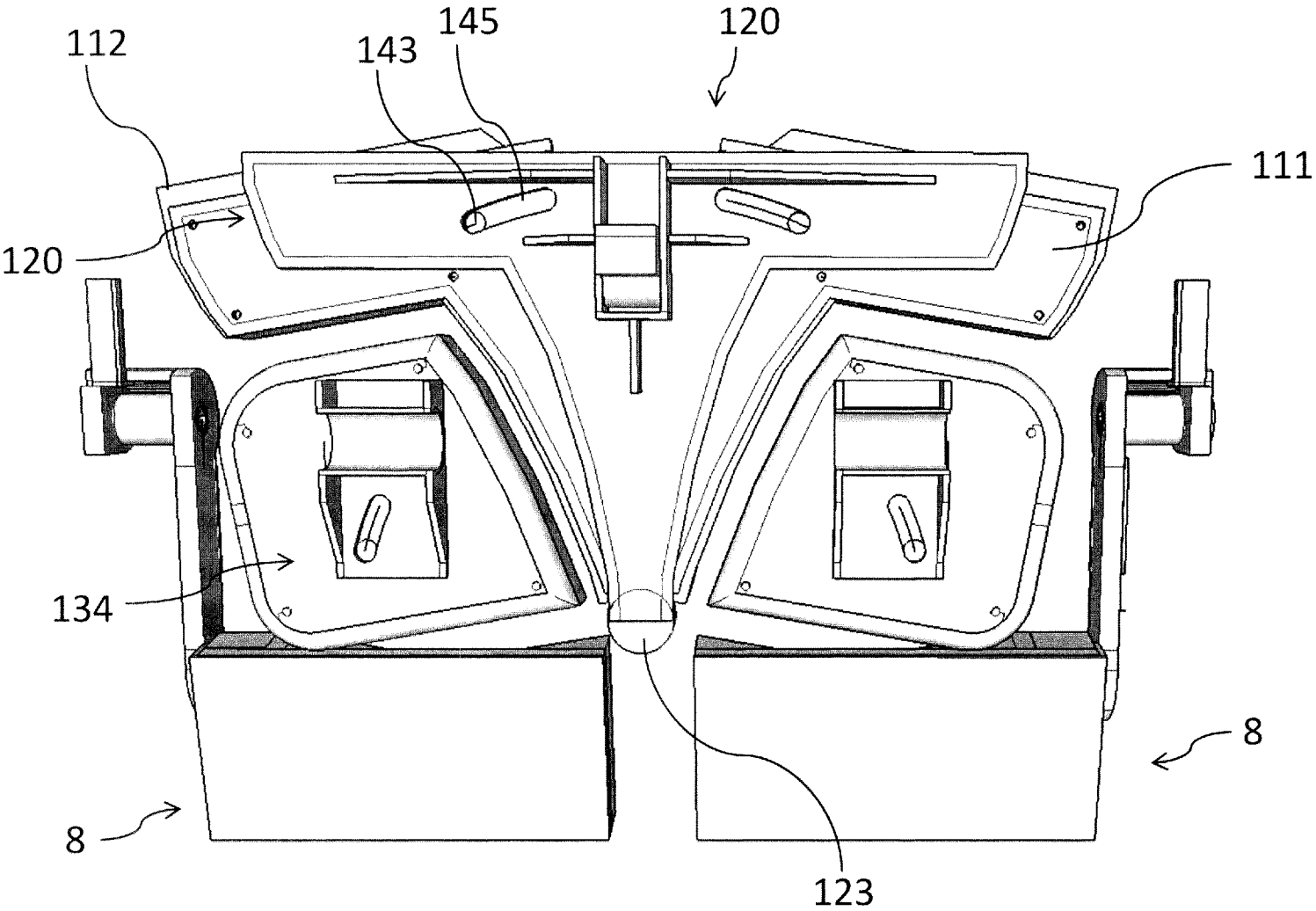
Figure 23:
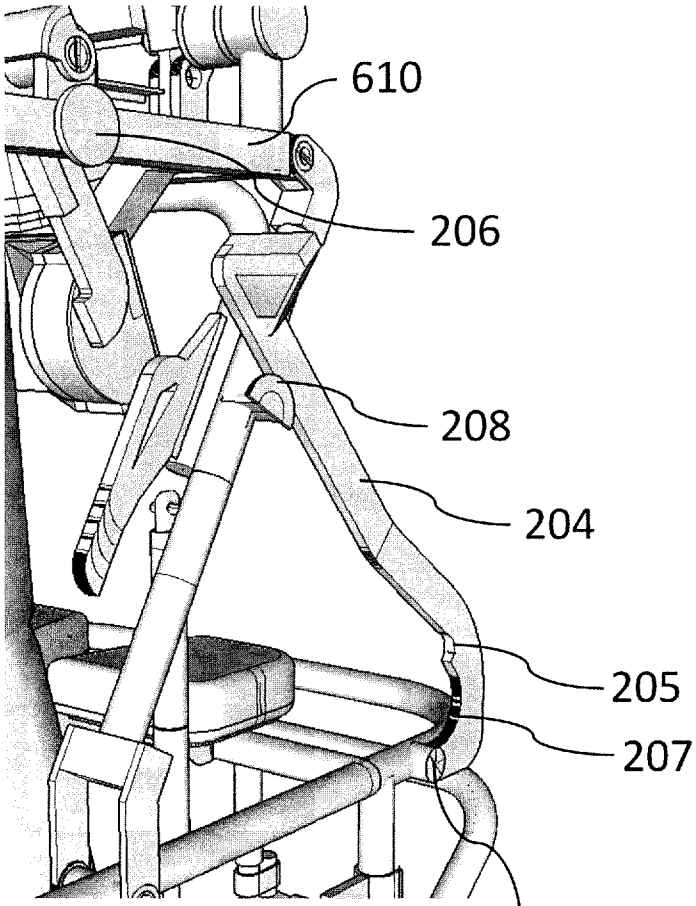
FIG. 23 is a perspective partial schematic representation of the walking aid wheelchair, in which the locking member is in an unlocking position.
Figure 22:
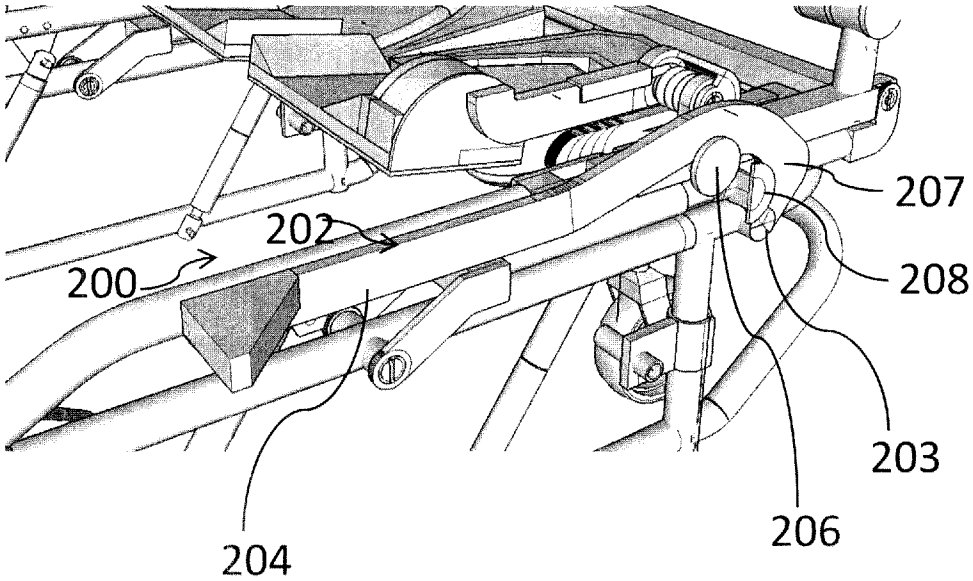
FIG. 22 is a perspective partial schematic representation of the walking aid wheelchair, in which the locking member is in a locking position.
Figure 24:
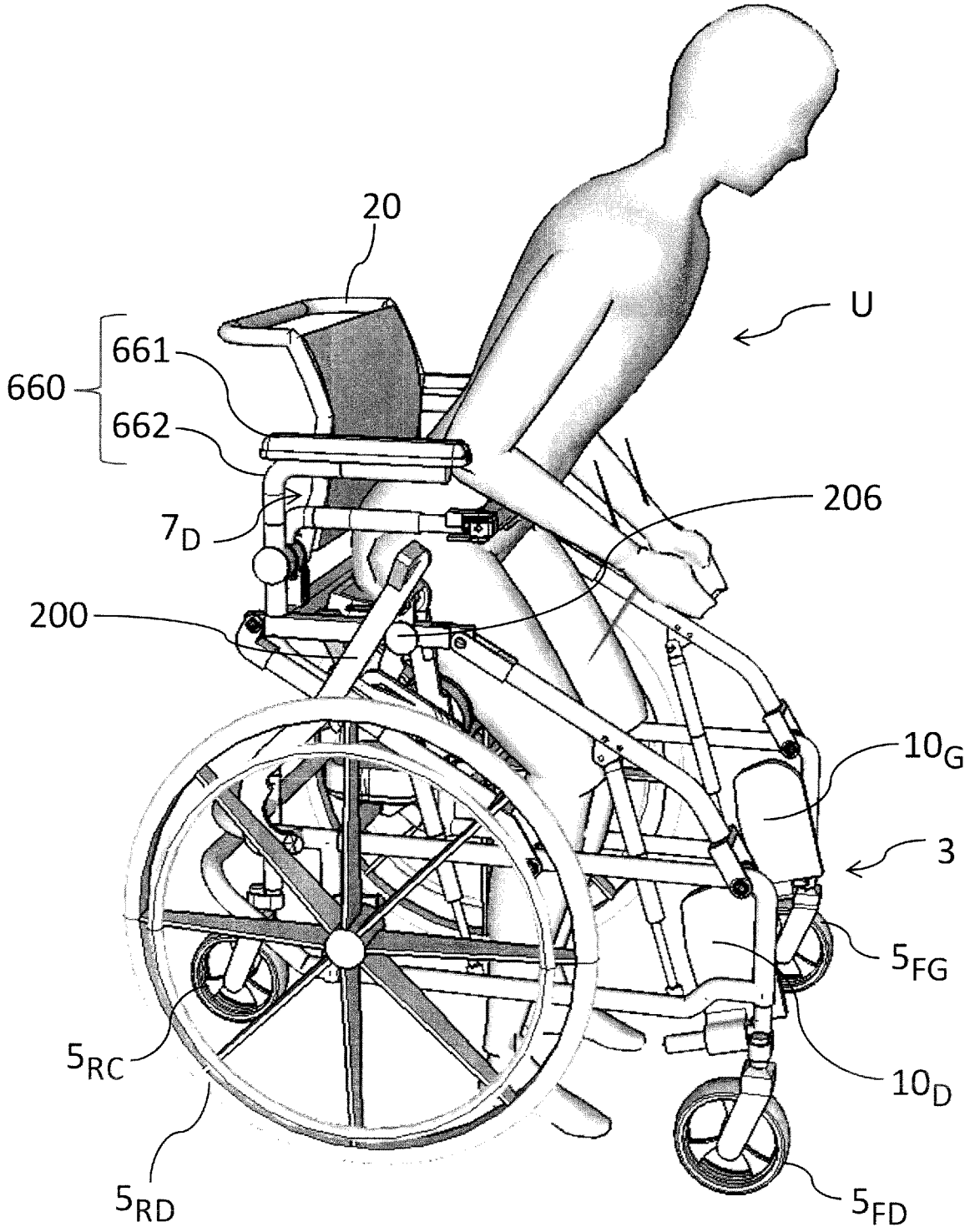
FIG. 24 is a perspective partial schematic representation of the walking aid wheelchair, wherein the base plate is in the intermediate position between the low position and the high position.
Figure 25:
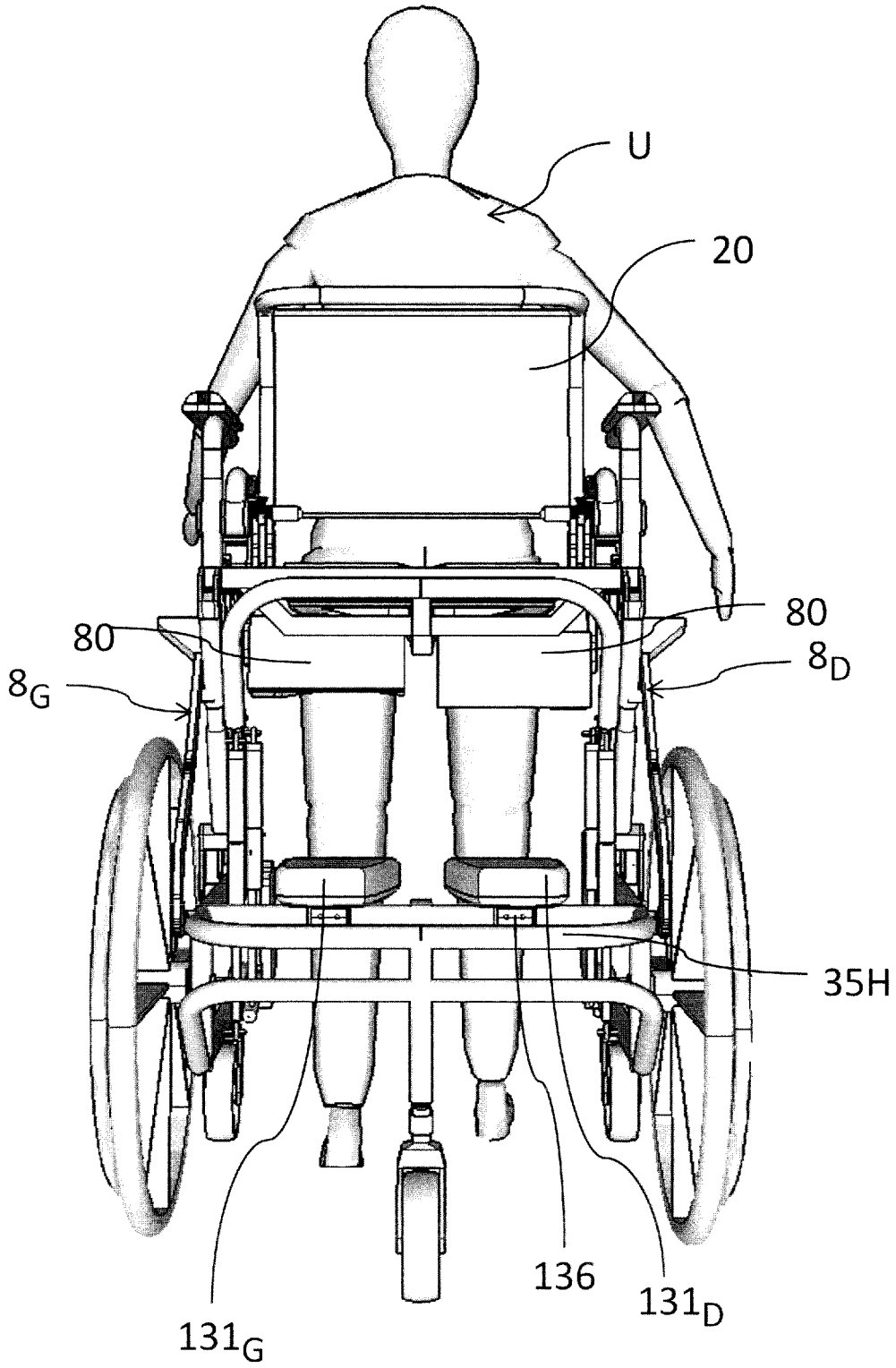
FIG. 25 is a rear view partial schematic representation of the walking aid wheelchair, wherein the base plate is in the intermediate position between the low position and the high position.

The walking aid wheelchair 1 according to the second embodiment further comprises a central rear wheel $\mathbf{5}_{RC}$ which is visible in FIGS. 24 and 25, left $\mathbf{10}_G$ and right $\mathbf{10}_D$ footrests, lower abutment members 130 which are for example visible in FIGS. 19 to 21, as well as a locking member 200 for locking the movable base plate which is for example represented in FIGS. 22 and 23.

The walking aid wheelchair 1 according to the second embodiment also comprises a chassis 3, front retaining members 7 and push rear members 8 which have a distinct structure respectively from that of the chassis 3, the front retaining members 7 and the push rear members 8 of the walking aid wheelchair 1 according to the first embodiment.

The backrest 20 is rigidly integral with the movable base plate 60 instead of being integral with the chassis 3. It is for example attached to a rear support element 640 being part of the frame 600 of the movable base plate 60.

The central rear wheel $\mathbf{5}_{RC}$ is a wheel with a smaller size than that of the left $\mathbf{5}_{RG}$ and right $\mathbf{5}_{RD}$ rear wheels. It has a similar size to that of the left $\mathbf{5}_{FG}$ and right $\mathbf{5}_{FD}$ Front wheels. It can in particular pivot relative to the chassis 3, to steer more readily the wheelchair 1.

Figure 11:
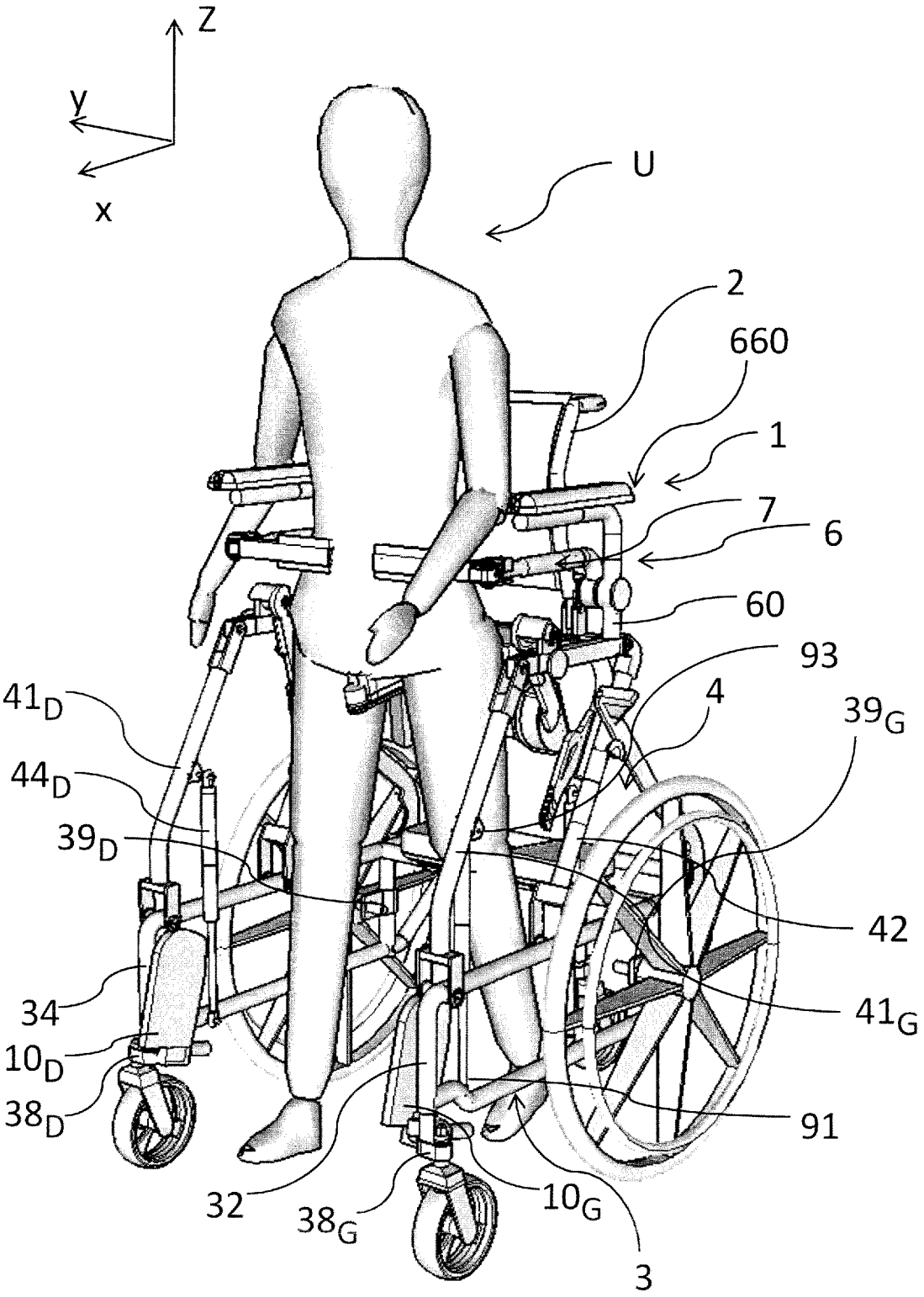
FIG. 11 is a perspective partial schematic representation of the walking aid wheelchair, in which the base plate is in the high walking position.

Each footrest $\mathbf{10}_G$, $\mathbf{10}_D$ is pivotably connected relative to the chassis 3 between a raised position which is represented in FIG. 11 and a lowered position. In the raised position, each footrest $\mathbf{10}_G$, $\mathbf{10}_D$ abuts against the front post 32, 34 to which it is connected, so as not to impede the U's user walk. In the lowered position, the footrests are oriented towards each other along the transverse direction Y-Y of the wheelchair 1, such that the user U can rest his/her feet thereon.

Figure 12:
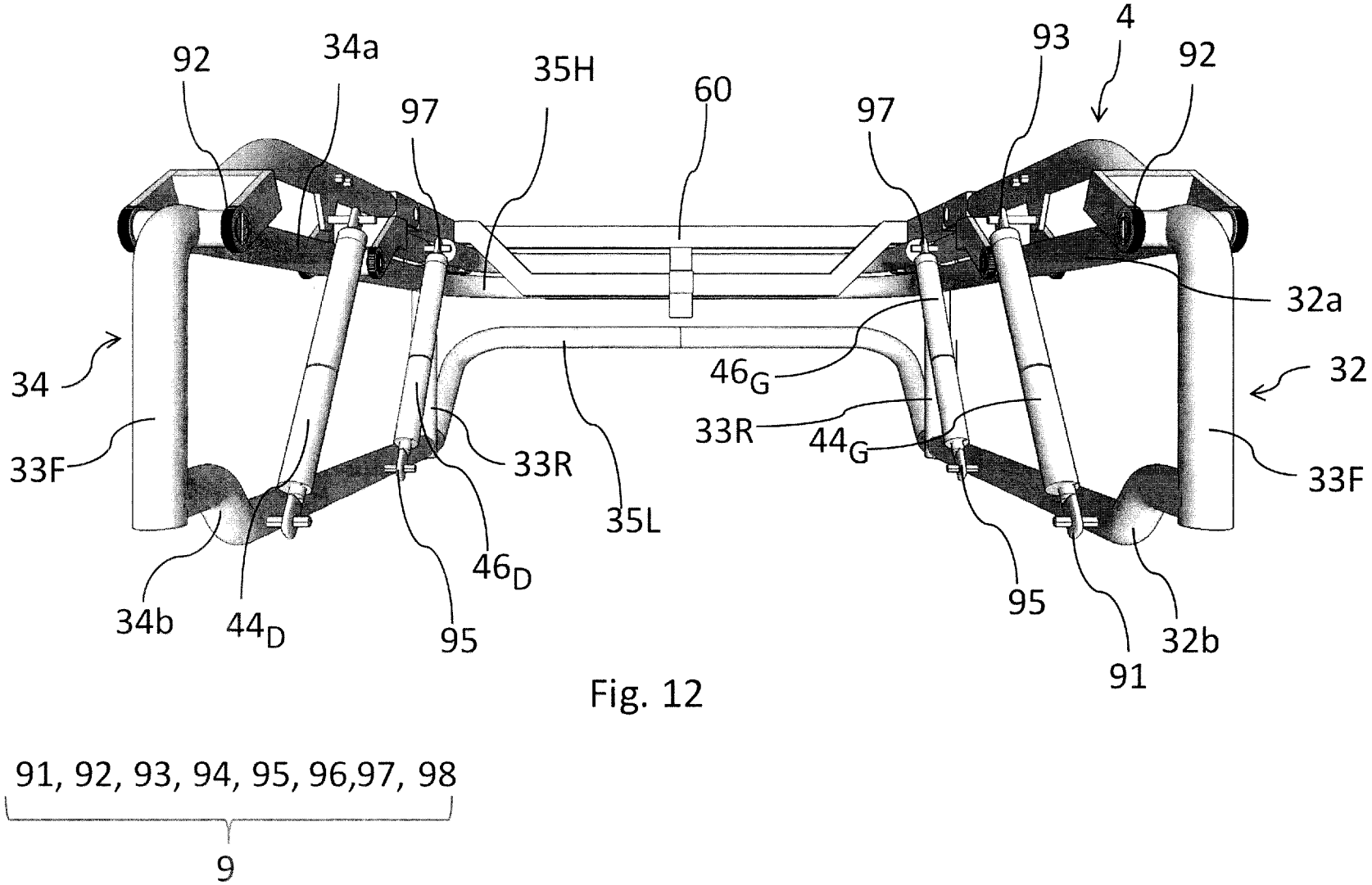
FIG. 12 is a perspective partial schematic representation of the movable base plate and of the position changing device of the wheelchair when the base plate is in the low sitting position.
Figure 13:
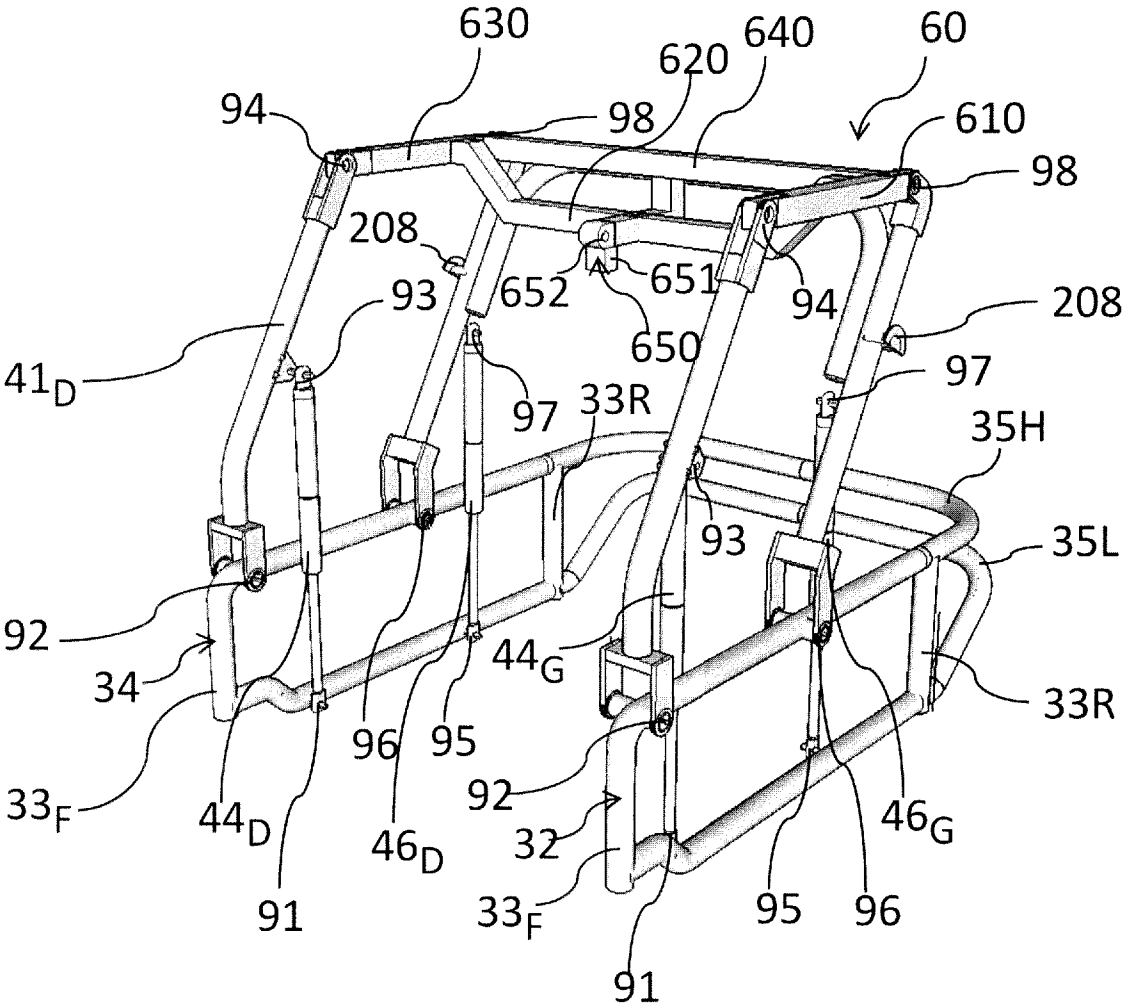
FIG. 13 is a perspective partial schematic representation of the movable base plate and of the position changing device of the wheelchair when the base plate is in the high walking position.

With reference more specifically to FIGS. 12 and 13, the chassis 3 of the chair according to the second embodiment is different from that according to the first embodiment in that it comprises an upper rear abutment bar $\mathbf{35}_H$ and a lower abutment bar $\mathbf{35}_L$, instead of the plate 36 of the chair according to the first embodiment.

The upper rear abutment bar $\mathbf{35}_H$ and the lower rear abutment bar $\mathbf{35}_L$ extend between both slender posts 32, 34 along a transverse direction Y-Y of the wheelchair 1, by mechanically connecting both slender posts 32, 34 to each other. They each have a generally curved tube shape.

The upper rear abutment bar $\mathbf{35}_H$ is located in the extension of the left 32*a* and right 34*a* support upper bars. The upper rear abutment bar $\mathbf{35}_H$ is located above the lower rear abutment bar $\mathbf{35}_L$. The upper rear abutment bar $\mathbf{35}_H$ forms a fixed base for the chassis 3 with another parallel transverse abutment bar which acts as a pedestal for the movable seat assembly 6, in particular for the base plate 60 in its low sitting position.

The lower rear abutment bar $\mathbf{35}_L$ is located in the extension of the left 32*b* and right 34*b* support lower bars.

With reference to FIGS. 10 to 13, the position changing device 4 comprises both first left $\mathbf{41}_G$, and right $\mathbf{41}_D$ arms, both first left $\mathbf{44}_G$ and right $\mathbf{44}_D$ linear actuators of the first left $\mathbf{41}_G$ and right $\mathbf{41}_D$ arms, both left $\mathbf{42}_G$ and right $\mathbf{42}_D$ second arms, a hinge assembly 9, as well as two second linear actuators $\mathbf{46}_G$, $\mathbf{46}_D$ for the second arms $\mathbf{42}_G$, $\mathbf{42}_D$.

The arms $\mathbf{41}_G$, $\mathbf{41}_D$, $\mathbf{42}_G$, $\mathbf{42}_D$, the movable base plate 60 and the chassis 3 have a generally deformable parallelogram shape which deforms, because of the hinge assembly 9, between the high walking position and the low sitting position.

The position changing device 4 is configured to move the base plate 60 with respect to the chassis 3 between the high walking position and the low sitting position. It moves the movable base plate 60 with respect to the chassis 3 in a circumferential translational motion between the high walking position and the low sitting position.

The first arms $\mathbf{41}_G$, $\mathbf{41}_D$ each extend between the chassis 3 and the base plate 60. Each first arm $\mathbf{41}_G$, $\mathbf{41}_D$ is connected at its lower end through a lower hinge 92 to one of the upper bars 32*a*, 34*a*. It is connected at its upper end through an upper hinge 94 to the movable base plate 60. The first arms $\mathbf{41}_G$, $\mathbf{41}_D$ are parallel to each other. They have a downwardly curved shape in the proximity of the lower hinge 92 relative to the first arms $\mathbf{41}_G$, $\mathbf{41}_D$ of the chair according to the first embodiment.

Each of the first arms $\mathbf{41}_G$, $\mathbf{41}_D$ forms an effort in the middle-type lever, also called third class lever, which is actuated by one of the first linear actuators $\mathbf{44}_G$, $\mathbf{44}_D$.

The second arms $\mathbf{42}_G$, $\mathbf{42}_D$ each extend between the chassis 3 and the movable base plate 60. Each second arm $\mathbf{42}_G$, $\mathbf{42}_D$ is connected at its lower end through a lower hinge 96 to one of the upper bars 32*a*, 34*a*. Each second arm $\mathbf{42}_G$, $\mathbf{42}_D$ is connected at its upper end through an upper hinge 98 to the movable base plate 60.

The second arms $\mathbf{42}_G$, $\mathbf{42}_D$ are located behind the first arms $\mathbf{41}_G$, $\mathbf{41}_D$, while being substantially parallel to the first arms $\mathbf{41}_G$, $\mathbf{41}_D$. More precisely, the axis of the hinges 92, 94 of the second arms are parallel to the axes of the hinges 96, 98 of the first arms. The second arms $\mathbf{42}_G$, $\mathbf{42}_D$ are parallel to each other. The second arms $\mathbf{42}_G$, $\mathbf{42}_D$ are parallel to each other. They have a downwardly curved shape in the proximity of the lower hinge 96 relative to the second arms $\mathbf{42}_G$, $\mathbf{42}_D$ of the chair according to the first embodiment.

Each second arm $\mathbf{42}_G$, $\mathbf{42}_D$ forms an effort in the middle-type lever, also called third class lever, which is actuated by one of the second linear actuators $\mathbf{46}_G$, $\mathbf{46}_D$.

The linear actuators $44_G$, $44_D$, $46_G$, $46_D$ are each passive linear actuators $44_G$, $44_D46_G$, $46_D$, that is non-motorised linear actuators.

Each linear actuator $44_G$, $44_D$, $46_G$, $46_D$ comprises an elastic return means which is configured to elastically bias the movable base plate 60 to the high position through one of the arms $41_G$, $41_D$, $42_G$, $42_D$. Each of the linear actuators $44_G$, $44_D$, $46_G$, $46_D$ comprises a cylinder. More precisely, each linear actuator $46_G$, $46_D$ comprises a gas spring loaded type cylinder.

The first linear actuators $44_G$, $44_D$ are each connected through a lower mechanical connection 91 to one of the lower bars 32*b*, 34*b* of the chassis 3 and through an upper mechanical connection 93 to one of the first arms $41_G$, $41_D$. The upper mechanical connection 93 is substantially located in the middle of the corresponding first arm $41_G$, $41_D$.

Each of the first linear actuators $44_G$, $44_D$ is configured to bias the movable base plate 60 to the high walking position through one of the first arms $41_G$, $41_D$. They enable the position changing device 4 to partially support the U's user weight upon switching from the low position to the high position, while allowing switching from the high position to the low position using the U's user weight exerted onto the movable base plate 60.

Each of the second linear actuators $46_G$, $46_D$ is connected through a lower mechanical connection 95 to one of the lower bars 32*b*, 34*b* of the chassis 3 and through an upper mechanical connection 97 to one of the second arms $42_G$, $42_D$. The upper mechanical connection 97 is substantially located in the middle of the corresponding second arm $42_G$, $42_D$.

Each of the second linear actuators $46_G$, $46_D$ is configured to bias the movable base plate 60 to the high walking position through the corresponding second arm $42_G$, $42_D$. They enable the position changing device 4 to partially support the U's user weight upon switching from the low position to the high position, while enabling switching from the high position to the low position using the U's user weight.

The hinge assembly 9 comprises the lower hinges 92 of the first arms, the upper hinges 94 of the first arms, the lower hinges 96 of the second arms, the upper hinges 98 of the second arms, the lower mechanical connection 91 of each first linear actuator $44_G$, $44_D$, the upper mechanical connection 93 of each first linear actuator $44_G$, $44_D$, the lower mechanical connection 95 of each second linear actuator $46_G$, $46_D$, the upper mechanical connection 97 of each second linear actuator $46_G$, $46_D$.

The lower hinges 92 of the first arms and the upper hinges 94 of the first arms are pivot connections. The lower hinges 92 of the first arms are in front of the upper hinges 94 of the first arms, whatever the position of the movable base plate 60 with respect to the chassis 3.

In other words, the first arms $41_G$, $41_D$ are upward rearward tilted. The movement of the movable base plate 60 upon switching from the low sitting position to the high walking position is performed with a motion relative to the chassis 3 which is upward forward, to better reproduce the U's user natural motion to stand-up. By way of example, the distance ratio between the forward movement of the U's user pelvis and the height increase in the U's user pelvis when he/she accompanies the movable base plate 60 in his/her movement between its low sitting position and its high walking position is about 4/5. On the other hand, the movable base plate 60 will tend to move rearward with respect to the chassis 3 when it lowers under the effect of the U's user weight which is exerted thereon. In other words, the tilt of the first arms $41_G$, $41_D$ moves forward the chassis 3 with respect to the user when the movable base plate 60 moves from its high walking position to its low sitting position.

The lower hinges 96 of the second arms and the upper hinges 98 of the second arms are pivot connections. The lower hinges 96 of the second arms are in front of the upper hinges 98 of the second arms, whatever the position of the movable base plate 60 with respect to the chassis.

In other words, the second arms $42_G$, $42_D$ are upward rearward tilted. The movement of the movable base plate 60 upon switching from the low sitting position to the high walking position is performed with a motion relative to the chassis 3 which is upward forward, to better reproduce a U's user natural motion to stand-up. On the other hand, the movable base plate 60 will tend to move rearward with respect to the chassis 3 when it lowers under the effect of the U's user weight which is exerted thereon. In other words, the tilt of the second arms $42_G$, $42_D$ moves the chassis 3 forward with respect to the user when the movable base plate 60 moves from its high walking position to its low sitting position.

The lower hinges 96 of the second arms are behind the corresponding lower hinges 92 of the first arms whatever the position of the movable base plate 60 with respect to the chassis 3.

The lower hinges 96 of the second arms are in front of the corresponding upper hinges 94 of the first arms, when the movable base plate 60 is in the low sitting position.

The upper hinges 98 of the second arm are behind the upper hinges 94 of the first arms whatever the position of the movable base plate 60 with respect to the chassis 3.

The lower mechanical connection 91 of each first linear actuator $44_G$, $44_D$ and the upper mechanical connection 93 of each first linear actuator $44_G$, $44_D$ are pivot connections. Each first linear actuator $44_G$, $44_D$ has a smaller angle relative to the normal to the first arm $41_G$, $41_D$ to which it is connected through the upper mechanical connection 93, in the proximity of the upper mechanical connection 93, when the movable base plate 60 is close to its low sitting position than when the movable base plate 60 is close to its high walking position.

For that reason, each first linear actuator $44_G$, $44_D$ tends to exert a more significant push force onto the first arm $41_G$, $41_D$, when the movable base plate 60 is close to its low sitting position than when the movable base plate 60 is close to its high walking position. The weight the user U exerts on the movable base plate 60 to sit down thus remains moderate with respect to the upward bias force of the base plate 60 by each first linear actuator $44_G$, $44_D$. This upward bias of each actuator $44_G$, $44_D$ thus does not block the user in the high position. The user U can thus lower himself/herself under the effect of his/her weight without risking a rearward movement, when he/she tends to sit down in the chair 1 or fall vertically or rearward.

The upper mechanical connection 93 of each first linear actuator $44_G$, $44_D$ is located behind the lower mechanical connection 91 of each first linear actuator $44_G$, $44_D$, over at least most of the stroke of the movable base plate 60 when it moves with respect to the chassis 3 between the high position and the low sitting position. The tilt of each first linear actuator $44_G$, $44_D$ is determined in particular for dimensioning reasons. The lever arm exerted by each linear actuator $44_G$, $44_D$ on the first arm $41_G$, $41_D$ is thereby satisfactory. Moreover, the lower hinge 91 of each actuator $44_G$, $44_D$ is not too low relative to the chassis 3.

The lower mechanical connection 91 of each first linear actuator $\mathbf{44}_G$, $\mathbf{44}_D$ and the upper mechanical connection 93 of each first linear actuator $\mathbf{44}_G$, $\mathbf{44}_D$ are pivot connections. Each first linear actuator $\mathbf{44}_G$, $\mathbf{44}_D$ has a smaller angle relative to the normal to the first arm $\mathbf{41}_G$, $\mathbf{41}_D$ to which it is connected through the upper mechanical connection 93, in the proximity of the upper mechanical connection 93, when the movable base plate 60 is close to its low sitting position than when the movable base plate 60 is close to its high walking position.

For that reason, each first linear actuator $\mathbf{44}_G$, $\mathbf{44}_D$ tends to exert a more significant push force onto the first arm $\mathbf{41}_G$, $\mathbf{41}_D$, when the movable base plate 60 is close to its low sitting position than when the movable base plate 60 is close to its high walking position. The weight the user U exerts onto the movable base plate 60 to sit down thus remains moderate with respect to the upward bias force of the base plate 60 by each first linear actuator $\mathbf{44}_G$, $\mathbf{44}_D$. This upward bias of each actuator $\mathbf{44}_G$, $\mathbf{44}_D$ thus does not block the user in the high position. The user U can thereby lower himself/herself under the effect of his/her weight without risking a rearward movement, when he/she tends to sit down in the chair 1 or fall vertically or rearward.

The upper mechanical connection 97 of each second linear actuator $\mathbf{46}_G$, $\mathbf{46}_D$ is located behind the lower mechanical connection 95 of each second linear actuator $\mathbf{46}_G$, $\mathbf{46}_D$, over at least most of the stroke of the movable base plate 60 when it moves with respect to the chassis 3 between the high position and the low sitting position. The tilt of each second linear actuator $\mathbf{46}_G$, $\mathbf{46}_D$ is determined in particular for dimensioning reasons. The lever arm exerted by each second linear actuator $\mathbf{46}_G$, $\mathbf{46}_D$ on the second arm $\mathbf{42}_G$, $\mathbf{42}_D$ is thereby satisfactory. Moreover, the lower hinge 95 of each second linear actuator $\mathbf{46}_G$, $\mathbf{46}_D$ is not too low relative to the chassis 3.

With reference more specifically to FIGS. 18 to 21 and FIG. 25, the movable seat assembly 6 comprises two left and right lower abutment members 130.

Each lower abutment member 130 is configured to be a rear abutment for part of the U's user lower limb $U_{ID}$, $U_{IG}$ at least in the low sitting position, in particular in the U's user gluteal region. It is located in front of the saddle 110 in the low sitting position. Each lower abutment member 130 is also called a buttock abutment in the rest of the description.

Each lower abutment member 130 comprises a fitting 131 and a fitting support 132 which is covered with the fitting 131. Each fitting 131 is connected to its fitting support 132 through a guiding pin 133 and through a groove 135 which are visible in FIGS. 20 and 21. Each lower abutment member 130 is connected through a fastener 136 to the chassis 3.

The left fitting $\mathbf{131}_G$ is configured to be in contact with a part of the user's left lower limb $U_{IG}$, in particular a part of his/her left buttock or his/her left thigh. This can for example be a cushion, the guiding pin 133 of which downwardly projects therefrom. The left fitting $\mathbf{131}_G$ has of a distinct shape from that of the right fitting $\mathbf{131}_D$. Its inner side surface is configured to be of a substantially complementary shape to the outer side surface of the left portion 111 of the saddle.

The right fitting $\mathbf{131}_D$ is configured to be in contact with part of the user's right lower limb $U_{ID}$, in particular part of his/her right buttock or his/her right thigh. This can for example be a cushion, the guiding pin 133 of which downwardly projects therefrom. The inner side surface meant of the right fitting $\mathbf{131}_D$ is configured to be of a substantially complementary shape to the outer side surface of the saddle right portion 112.

The fitting support 132 of each lower abutment member 130 is configured to be rigidly integral with the chassis. In the represented embodiment, the fitting support 132 of each lower abutment member 130 is connected through screwing to a transverse abutment bar of the chassis 3 which is located in front of the upper rear abutment bar $\mathbf{35}_H$ of the chassis 3. The fitting support 132 comprises the groove 135 in its central part.

The guiding pin 133 and the groove 135 of each lower abutment member 130 form together a side adjustment means 134 for adjusting the fitting $\mathbf{131}_G$, $\mathbf{131}_D$ with respect to the corresponding fitting support 132. Because of each side adjustment means 134, each fitting $\mathbf{131}_G$, $\mathbf{131}_D$ is at least partly laterally adjustable relative to the chassis 3.

With reference more specifically to FIG. 13 and to FIGS. 18 to 22, the movable base plate 60 of the chair according to the second embodiment is different from that of the chair according to the first embodiment in that it comprises a saddle 110, the backrest 20, a frame 600 and armrests 660.

With reference in particular to FIGS. 18 to 21, the saddle 110 comprises a saddle left portion 111, a saddle right portion 112, a central hinge 123 and a saddle base 120. Each saddle left 111 or right 112 portion is connected through a groove 145 and through a guiding pin 143 to the saddle base 120. The saddle base 120 is connected to the frame 600.

The saddle left portion 111 is configured to be in contact with part of the user's left lower limb $U_{IG}$, in particular part of his/her left buttock. This is for example a cushion, the guiding pin 143 of which downwardly projects therefrom. The saddle left portion 111 is of a shape distinct from that of the saddle right portion 112. The inner side surface of the saddle left portion 111 is configured to be of a substantially complementary shape to that of the inner side surface of the saddle right portion 112.

The saddle right portion 112 is configured to be in contact with part of the user's right lower limb $U_{ID}$, in particular a part of his/her right buttock. This is for example a cushion, the guiding pin 143 of which downwardly projects therefrom.

The central hinge 123 connects the front end of the saddle left portion 111 to the saddle base 120, in a laterally movable pivot connection. The central hinge 123 connects the front end of the saddle right portion 112 to the saddle base 120, in a laterally movable pivot connection.

The saddle base 120 is configured to be connected through the central hinge 123 to the fastener 650 of the frame 600, by being vertically tiltable relative to the fastener 650. The saddle base 120 comprises a groove 145 for each saddle portion 111, 112. These grooves 145 are located on either side of the central part of the saddle base 120.

Each guiding pin 143 and the corresponding groove 145 form together a side adjustment means 142 of one of the saddle portions 111, 112 with respect to the saddle base 120. Because of this side adjustment means 142, each saddle portion 111, 112 is at least partly laterally adjustable relative to the frame 600.

With reference more specifically to FIG. 13, the frame 600 of the movable base plate 60 comprises a left support element 610, a right support element 630, a front transverse support element 620, a rear transverse support element 640 and a saddle fastener 650. The frame 600 acts as a support for the saddle 110. The frame 600 and the saddle 110 replace the side support elements 61, 63 and the intermediate support element 62 of the movable base plate 60 of the wheelchair 1 according to the first embodiment.

The first left arm $\mathbf{41}_G$ and the second left arm $\mathbf{42}_G$ are mechanically connected through the upper hinges 94, 98 to the left support element 610.

The first right arm $\mathbf{41}_D$ and the second right arm $\mathbf{42}_D$ are mechanically connected through the upper hinges 94, 98 to the right support element 630.

The front transverse support element 620 extends along the transverse direction Y-Y of the wheelchair from the left support element 610 to the right support element 630, in the proximity of a median part of the left 610 and right 630 support elements along their longitudinal direction. The front transverse support element 620 has a generally U shape. The saddle fastener 650 is rigidly integral with the front transverse support element 620. It is in particular in one piece with the transverse support element 620.

The rear transverse support element 640 extends along the transverse direction Y-Y of the wheelchair from the left support element 610 to the right support element 630, in the proximity of the upper hinges 98 of the left $\mathbf{42}_G$ and right $\mathbf{42}_D$ second arms.

The fastener 650 for the saddle 110 comprises a stop 651 which projects vertically downwardly therefrom and a connecting hole 652 for the saddle 110. The connecting hole 652 is used to connect the saddle 110 to the front support element 620 through a pivot connection about the transverse direction Y-Y, such that the saddle 110 is tiltable along the height direction Z-Z with respect to the frame 600. The stop 651 acts as a stop for the saddle 110 downwardly with respect to the frame 600.

Figure 10:
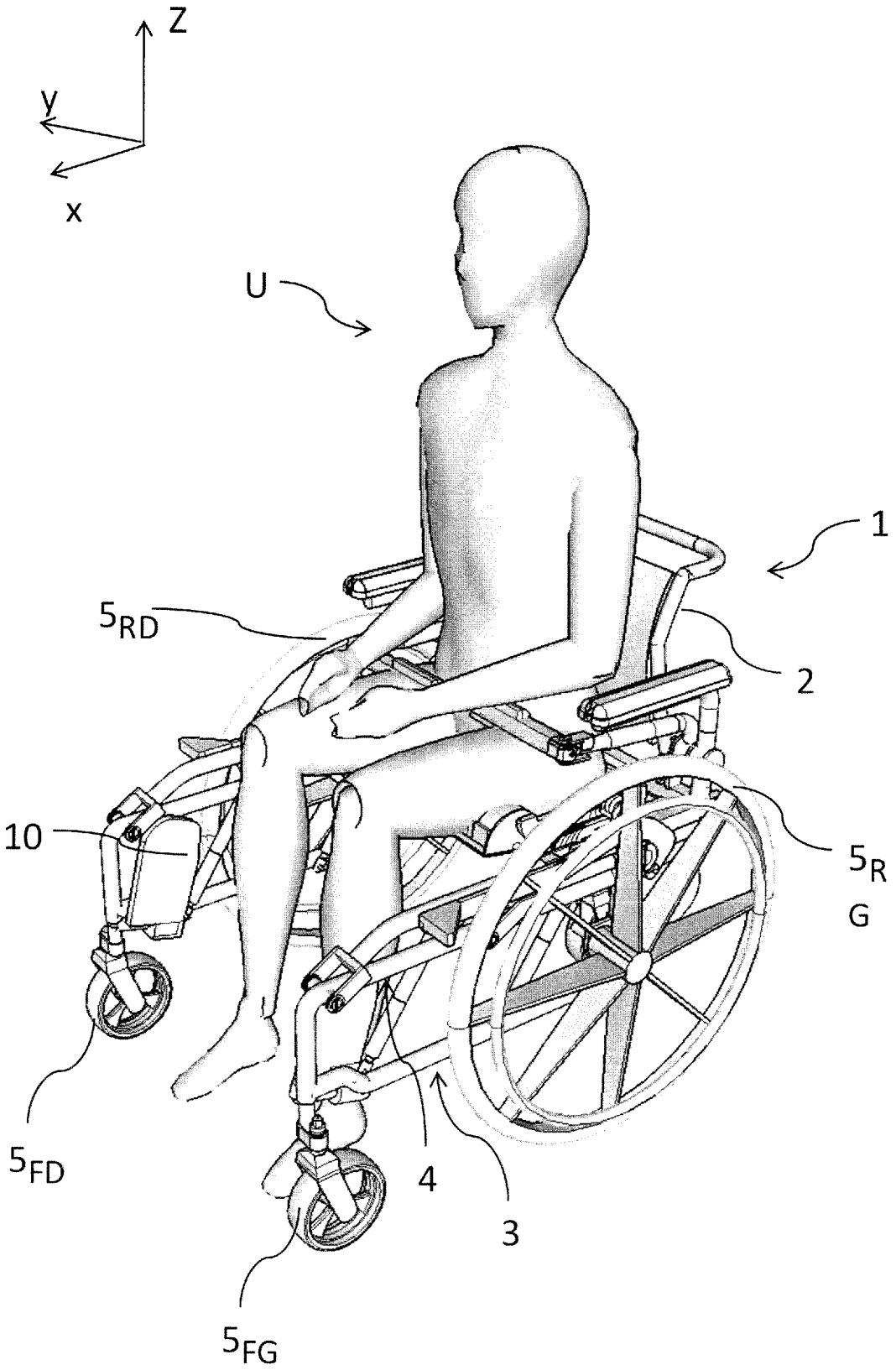
FIG. 10 is a perspective partial schematic representation of a walking aid wheelchair, according to a second embodiment of the invention, in which the movable base plate is in the low sitting position.

With reference to FIGS. 10, 11 and 24 together, the wheelchair 1 comprises two armrests 660 which are each rigidly integral with one of the left 610 and right 630 support elements of the frame. Each armrest 660 comprises a support arm 662 and an upper fitting 661. The armrests 660 are usable by the user U in the high walking position and also in the low sitting position.

The support arm 662 has a bracket shape. Each support arm 662 is connected to the corresponding left 610 or right 630 support element, in the proximity of the upper hinge 98 of the second arms $\mathbf{42}_G$, $\mathbf{42}_D$. The upper surface of each support arm 662 is covered with one of the upper fittings 661. Each support arm 662 is also used to connect one of the front retaining members 7 to the movable base plate 60, by acting as a base for the corresponding front retaining member 7.

Each upper fitting 661 takes for example the form of an oblong cushion.

Figure 16:
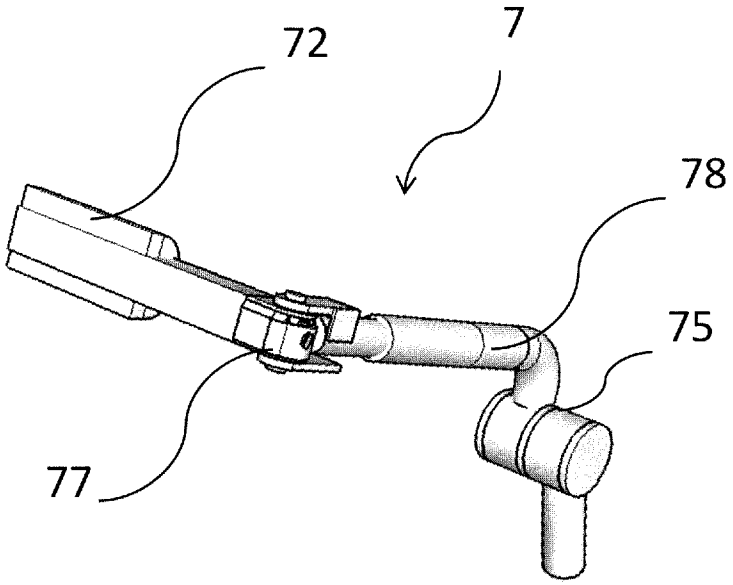
FIG. 15 and FIG. 16 are perspective partial schematic representations of a front retaining member of the wheelchair, in two closed positions which are distinct by their tilt.
Figure 15:
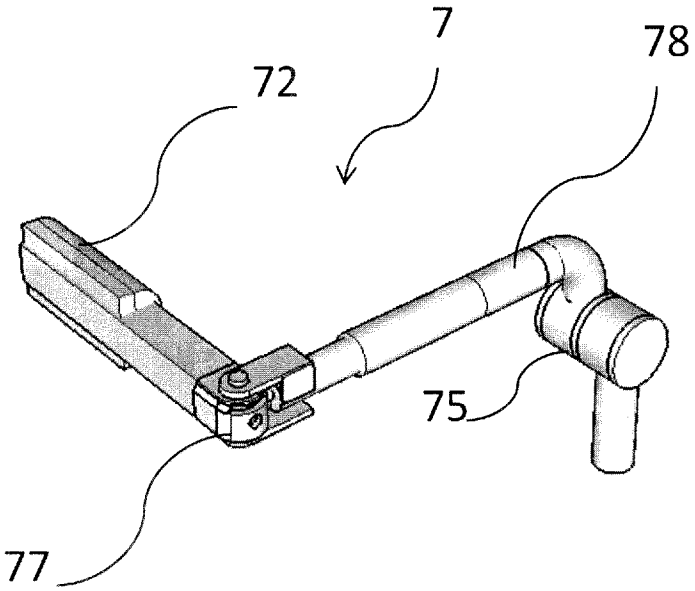
Figure 17:
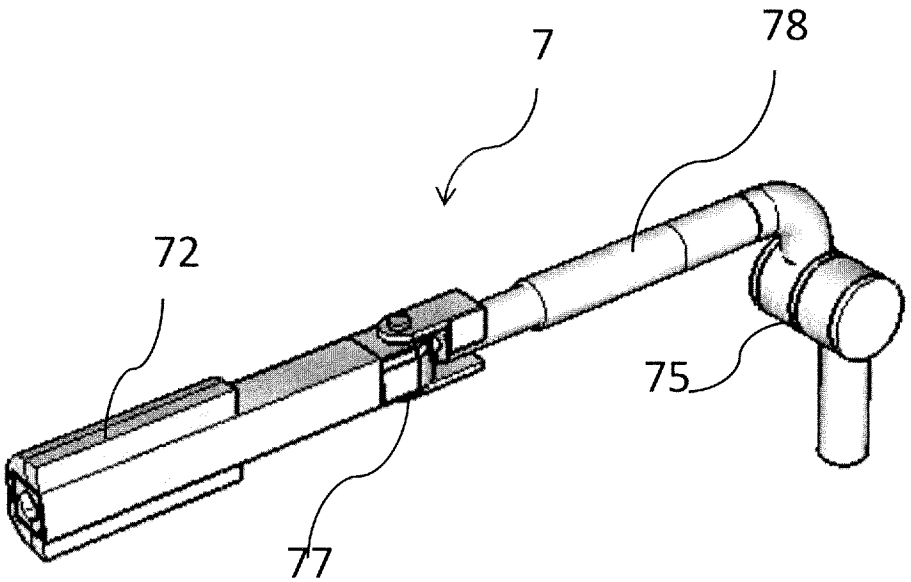
FIG. 17 is a perspective partial schematic representation of a front retaining member of the wheelchair, in an open position.
Figure 18:
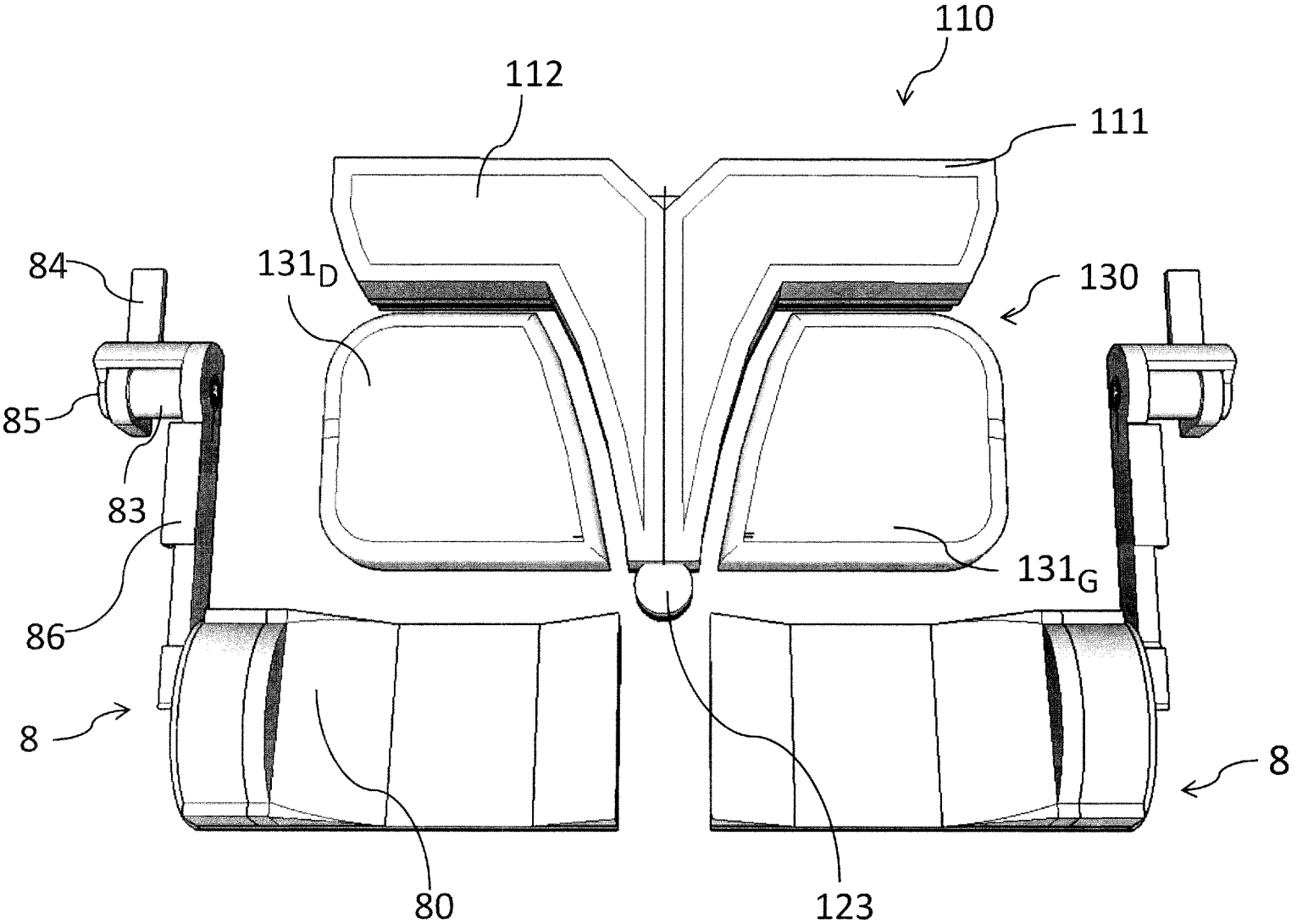
FIG. 18 and FIG. 19 are top view partial schematic representations of the adjustable seat of the walking aid wheelchair, in two positions which are distinct by the side position of the saddle and of the lower abutments.

With reference to FIGS. 15 to 17, each front retaining member $\mathbf{7}_G$, $\mathbf{7}_D$ comprises a first hinge 75, an arm 78, a second hinge 77 and the front abutment element 72.

The first hinge 75 pivotably connects the arm 78 of the front retaining member to one of the support arms 662 of the armrest 660, about the transverse direction Y-Y.

The second hinge 77 pivotably laterally connects the front abutment element 72 to the arm 78 of the front retaining member. The front abutment element 72 is laterally movable about the second hinge 77 between an open position which is represented in FIG. 17 and at least one closed position such as those represented in FIG. 15 and in FIG. 16.

In the open position, the front abutment element 72 lets the user U sit down on the movable base plate 60. In the closed position, the front abutment element 72 retains the user U forward relative to the frame 600 of the movable base plate 60.

In the closed position, the front abutment element 72 is configured to be able to freely pivot relative to the support arm 662 between an upper position and a lower position. The front abutment element 72 is represented in the lower closed position in FIG. 15. It is represented in the upper closed position in FIG. 16.

Figure 14:
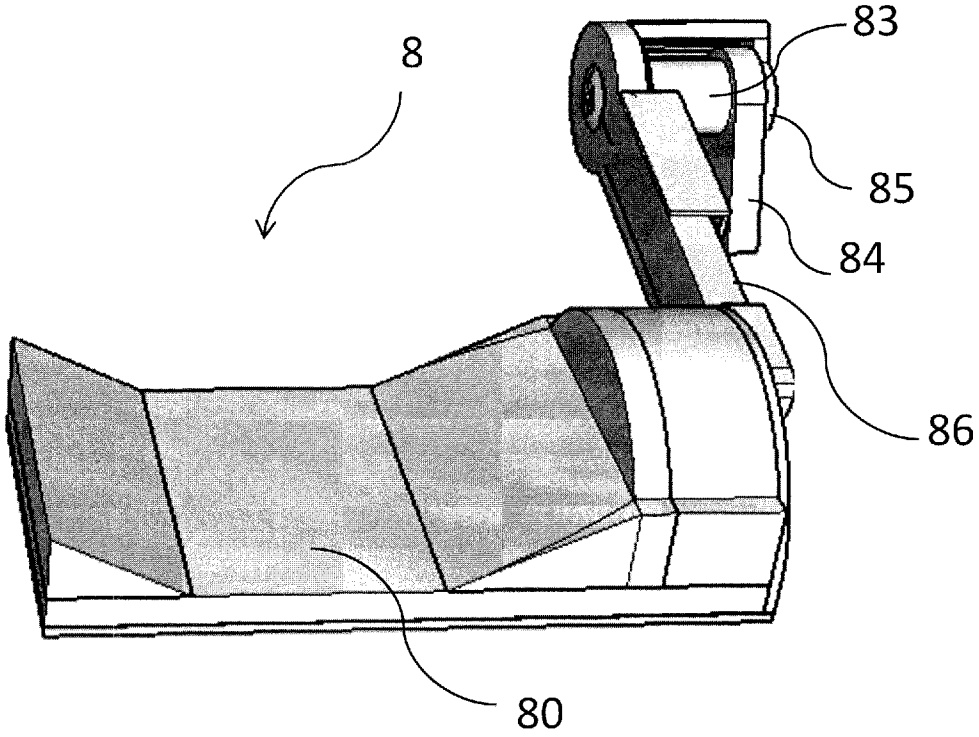
FIG. 14 is a perspective partial schematic representation of a push rear member of the wheelchair.

With reference more specifically to FIG. 14 and to FIGS. 18 to 21, each push rear member 8 comprises a rear abutment element 80, a support arm 86, a return means 83, a support 84 and a connection member 85.

Each push rear member 8 is configured to be in front of the saddle 110 and lower abutment members 130 of the movable base plate 60 in the low sitting position and in the high walking position.

The push rear members $\mathbf{8}_G$, $\mathbf{8}_D$ are each configured to bias one of the U's user lower limbs $U_{ID}$, $U_{IG}$ forward during walking. For that reason, the U's user walk is made easier.

Each rear abutment element 80 is of a concave shape which is configured to perfectly fit the shape of the user's lower limb $U_{ID}$, $U_{IG}$, in particular of the U's user rear thigh against which the rear abutment element 80 abuts in the high position and in the low position.

The return means 83 takes the form of a spring, for example a torsion spring. It is configured to bias the rear abutment element 80 forward, which makes it easier for the U user to walk. The user U counters the return force of each return means 83, in particular thanks to his/her weight, when the lower limb which is on the ground moves backward upon walking with respect to the other of the lower limbs.

Each of the supports 84 is attached to one of the left 610 and right 630 support elements. The connection member 85 comprises a rod. This is a pivot connection configured to pivot the rear abutment element 80 forward relative to the movable base plate 60.

The support arm 86 connects the rear abutment element 80 to the support 84. It is configured to pivot about the connection member 85. It is laterally located outwardly of the rear abutment element 80 it connects to the support 84.

With reference to FIG. 11 and FIGS. 22 to 24 together, the walking aid wheelchair 1 comprises a locking member 200 for locking the movable base plate 60 into the low sitting position.

The locking member 200 comprises a locking bar 202, a hinge 203 of the locking bar, a locking pin 206 and a retaining member 208 for retaining on the left side of the walking aid wheelchair 1.

The locking member 200 comprises a locking bar 202, a hinge 203 of the locking bar, a locking pin 206 and a retaining member 208 for retaining on the right side of the walking aid wheelchair 1.

Each locking bar 202 is pivotably connected relative to the chassis 3 through the hinge 203 of the locking bar. It comprises a locking arm which forms the body of the locking bar 202, a first notch 205 for housing the locking pin 206, and a second notch 207 for housing the retaining member 208. The locking arm is designed to be readily accessible by the user's hand and to be movable by the U's user hand when he/she is in the walking aid wheelchair 1. The second notch 207 is located behind the first notch 205.

Each hinge 203 of the locking bar is a pivot connection. It connects one of the locking bars 202 to the left support upper bar 32*a* of the chassis 3. It is located in the proximity of the lower longitudinal end of the locking bar 202.

Each locking pin 206 is rigidly integral with the movable base plate 60. It is in particular rigidly integral with the left 610 or right 630 support element, from which it projects laterally outwardly from the wheelchair 1. It has for example a rounded contour.

Each retaining member 208 is integral with the second left $42_G$ or right $42_D$ arm from which it projects laterally outwardly from the wheelchair 1. It has for example a rounded contour. It acts both as a locking catch complementary to one of the locking pins 206, and to guide the movement of the corresponding locking bar 202 between its unlocking high position and its locking low position.

The locking member 200 is movable between a locking position in which the movable base plate 60 is in the low sitting position and an unlocking position in which the movable base plate is in the high walking position.

In the locking position, each locking bar 202 is in the low position and it runs along the left 32*a* or right 34*a* support upper bar of the chassis. Each locking pin 206 is engaged in the first notch 205 of one of the locking bars 202. Each retaining member 208 is engaged in the second notch 207 of one of the locking bars 202.

In the unlocking position, each locking bar 202 is in the high position and it is tilted upward with respect to the upper bar of the left support 32*a* of the chassis and to the hinge 203. Each locking pin 206 is above and in front of the corresponding first notch 205. Each retaining member 208 is above and in front of the corresponding second notch 207. Each locking bar lies on one of the retaining members 208.

Switching from the low sitting position to the high walking position is described below with reference to FIGS. 10, 24 and 11 successively.

In FIG. 10, the user U sits in the wheelchair 1, the movable base plate 60 is in the low sitting position with the locking member 200 locked. The position changing device 4 is in its folded position which is represented in FIG. 3. The backrest 20 prevents the user U from falling rearward. The front retaining elements 7 prevent the user U from falling forward.

In FIG. 24, the user U is standing-up from the wheelchair 1, the movable base plate 60 lifts between the low sitting position and the high walking position, while accompanying the U's user movement. The position changing device 4 is in an intermediate position between its folded position which is represented in FIG. 12 and its deployed position which is represented in FIG. 13. The linear actuators $44_D$, $44_G$, $46_D$, $46_G$ bias the movable base plate 60 to its high walking position.

The bias push of the linear actuators $44_D$, $44_G$, $46_D$, $46_G$ is highest in the low sitting position, it gradually decreases as the angle at the normal to the arm of each actuator $44_D$, $44_G$, $46_D$, $46_G$ increases upon lifting the movable base plate. Conversely, the arms $41_D$, $41_G$, $42_D$, $42_G$ support an increasingly high tangential force of the user's weight as the movable base plate 60 lifts to the high walking position. The position changing device 4 partially catches again the U's user weight over the entire lift stroke of the movable base plate 60. Thus, it helps the user U to stand-up and remain standing. The front retaining elements 7 prevent the user U from falling forward.

In FIG. 11, the user U is standing. The U's user weight is partially supported by the position changing device 4 which helps the user U to remain in the standing position. His/her right $U_{ID}$, and left $U_{IG}$ lower limbs are biased forward by the right $8_D$ and left $8_G$ push rear members. The movable base plate 60 is in the high walking position. The position changing device 4 is in its deployed position which is represented in FIG. 13. The front retaining elements 7 prevent the user U from falling forward.

With reference to FIG. 11, the front retaining elements 7 prevent the user U from falling forward. They also enable him/her to walk by driving the wheelchair 1 with him/her, while he/she has his/her hands free.

The user U can use the walking aid wheelchair 1 on his/has own and securely.

In case of an intentional or unintentional fall of the user U rearward or vertically with respect to the ground, the position changing device 4 tends to limit his/her movement speed downwardly and to bring the movable base plate 60 to its low sitting position for him/her to sit thereon, in the position represented in FIG. 1 or in FIG. 10.

The position changing device 4 can move the movable base plate 60 with respect to the chassis 3 from the low sitting position to the high walking position, with a reduced risk of fall from the wheelchair 1.

The position changing device 4 moves the chassis 3 forward with respect to the movable base plate 60, when the user U desires to sit or when the user U tends to fall rearward or vertically.

Moreover, the movement of the movable base plate 60 upon switching from the low sitting position to the high walking position is performed with a motion with respect to the chassis 3 which is upward and forward and which reproduces the U's user natural motion to stand-up.

The position changing device 4 partially supports the U's user weight upon switching from the low position to the high position, while enabling switching from the high position to the low position using the U's user weight.

The wheelchair 1 has a dynamic seat, in that the position of the movable base plate 60 with respect to the chassis 3 is variable as a function of the weight exerted by the user U onto the movable base plate 60, including during walking.

The wheelchair 1 requires a moderate force from the user U to stand-up, walk and sit down. In particular, it is adapted to reeducate the user U in walking or to keep him/her able to walk. The assistance brought about to the user U by the actuators $44_G$, $44_D$, $46_G$, $46_D$ can be modified to better adapt to the U's user needs.

The movement guiding of the movable base plate 60 and the stability of the movable base plate 60 with respect to the chassis 3 are particularly satisfactory thanks to the lifting device 4 and in particular the plurality of arms $44_G$, $44_D$, $46_G$, $46_D$.

The intensity of the lift force of the movable base plate 60 exerted by each actuator $44_G$, $44_D$, $46_G$, $46_D$ of the gas spring loaded type does not vary much with respect to a motorised cylinder during the stroke of each actuator $44_G$, $44_D$, $46_G$, $46_D$, while only making the movable base plate 60 support partially the U's user weight.

By employing gas spring loaded type actuators for $44_G$, $44_D$, $46_G$, $46_D$, the mass of the wheelchair 1 is lightened with respect to a walking aid wheelchair with motorised actuators. The maintenance operations of the lifting device 4 are lighter than in the case of a lifting device 4 with motorised actuators.

Because of the position of the arms $41_G$, $41_D$, $42_G$, $42_D$ and the actuators $44_G$, $44_D$, $46_G$, $46_D$, the bulk of the lifting device 4 is reduced. The user U also enjoys a relatively significant walking space. He/she can readily come in and out his/her chair 1.

Of course, various modifications can be brought by those skilled in the art to the invention just described without departing from the scope of the disclosure of the invention.

Generally, the number of wheels $5_{RG}$, $5_{RD}$, $5_{FG}$ and $5_{FD}$ is variable. In particular, the wheelchair 1 can include a single front wheel or a single rear wheel.

The structure and the shape of the chassis 3 can vary.

For example, according to one alternative embodiment (not represented) at least one of the slender posts 32, 34 takes the form of a plate in place of the lower bars 32*b*, 34*b* and the upper bars 32*a*, 34*a*.

Alternatively, the lower bars 32*b*, 34*b* and the upper bars 32*a*, 34*a* can be mechanically connected to each other forward and/or rearward only by the wheel supports $\mathbf{38}_G$, $\mathbf{38}_D$, $\mathbf{39}_G$, $\mathbf{39}_D$.

Alternatively or in addition, the slender posts 32, 34 are not rectilinear, by for example extending along the longitudinal direction X-X by being incurved.

The number of arms $\mathbf{41}_G$, $\mathbf{41}_D$, $\mathbf{42}_G$, $\mathbf{42}_D$ and of linear actuators $\mathbf{44}_G$, $\mathbf{44}_D$ is variable. Generally, the wheelchair 1 comprises at least one first arm $\mathbf{41}_G$, $\mathbf{41}_D$ and at least one linear actuator $\mathbf{44}_G$, $\mathbf{44}_D$ which is mechanically connected to the first arm $\mathbf{41}_G$, $\mathbf{41}_D$.

Alternatively, the linear actuators $\mathbf{44}_G$, $\mathbf{44}_D$, $\mathbf{46}_G$, $\mathbf{46}_D$ comprise a spring or any other type of elastic return means configured to bias the base to its high walking position.

Alternatively or in addition, the linear actuators $\mathbf{44}_G$, $\mathbf{44}_D$, $\mathbf{46}_G$, $\mathbf{46}_D$ are motorised. In this case, the linear actuators $\mathbf{44}_G$, $\mathbf{44}_D$, $\mathbf{46}_G$, $\mathbf{46}_D$ are for example controlled by the user to make it easier to lift and/or lower the movable base plate 60. Alternatively, the wheelchair 1 includes for example a pressure sensor and a computing unit, to determine a pressure representative of the weight exerted by the user U onto the movable base plate 60 and to vary the power provided by each linear actuator $\mathbf{44}_G$, $\mathbf{44}_D$, $\mathbf{46}_G$, $\mathbf{46}_D$ accordingly.

The power provided by each actuator $\mathbf{44}_G$, $\mathbf{44}_D$, $\mathbf{46}_G$, $\mathbf{46}_D$ can be different from that provided by at least another of the actuators $\mathbf{44}_G$, $\mathbf{44}_D$, $\mathbf{46}_G$, $\mathbf{46}_D$, in particular if the user U requires a more important assistance from the actuators $\mathbf{44}_G$, $\mathbf{44}_D$, $\mathbf{46}_G$, $\mathbf{46}_D$ for one of his/her lower limbs $U_{ID}$, $U_{IG}$ than for the other.

Alternatively or in addition, the linear actuators $\mathbf{44}_G$, $\mathbf{44}_D$, $\mathbf{46}_G$, $\mathbf{46}_D$ can be mechanically connected by other connection types than by pivot connections to the arms $\mathbf{41}_G$, $\mathbf{41}_D$, $\mathbf{42}_G$, $\mathbf{42}_D$ and to the chassis 3, for example by swivel connections.

The shape and structure of the retaining members 7 and the push members 8 are variable. Alternatively or in addition, each front retaining member $\mathbf{7}_G$, $\mathbf{7}_D$ comprises for example a safety belt.

Alternatively or in addition, the walking aid wheelchair 1 comprises a locking member 200 for locking the movable base plate 60 into the high walking position.

Alternatively, the locking member 200 comprises a single locking bar 202 which is configured to engage a single locking pin 206 in the locking position. The locking bar 202 is thereby located on the left or right side of the wheelchair 1.

The invention claimed is:

1. A walking aid wheelchair, comprising:

a chassis, a movable base plate which is movable relative to the chassis between a low sitting position in which a user can sit thereon, and a high walking position in which it is configured to be in contact with the user and at least partially behind the user, a position changing device for the base plate, configured to move the base plate between the high position and the low position, wherein the position changing device comprises at least one first arm extending between the chassis and the base plate, and a linear actuator which is connected through a lower mechanical connection to the chassis and by an upper mechanical connection to the first arm, wherein the upper mechanical connection of the linear actuator is located behind the lower mechanical connection of the linear actuator when the movable base plate is at least in a position between the high position and the low position, wherein the linear actuator is configured to bias the movable base plate to the high position through the first arm, wherein the first arm comprises an upper end and a lower end, wherein the first arm is connected at its lower end through a lower hinge to the chassis and at its upper end through an upper hinge to the movable base plate, wherein the upper hinge is located behind and at or above the lower hinge over the entire stroke of the movable base plate when the movable base plate moves from the low position up to the high position, and wherein the first arm forms a third class lever.

2. The walking aid wheelchair according to claim 1, wherein the linear actuator comprises an elastic return means configured to elastically bias the movable base plate to the high position through the arm.

3. The walking aid wheelchair according to claim 2, wherein the linear actuator is passive, and wherein the linear actuator comprises a gas spring loaded type cylinder.

4. The walking aid wheelchair according to claim 1, comprising at least two first arms each extending between the chassis and the base plate, and two linear actuators which are each connected through a lower mechanical connection to the chassis and through an upper mechanical connection to one of the arms, wherein the linear actuators are configured to bias the movable base plate to the high position through the first arms, wherein the first arms each form a third class lever, wherein each first arm further comprises an upper end and a lower end, wherein each first arm is connected at its lower end through a lower hinge to the chassis and at its an upper end through an upper hinge to the movable base plate, wherein the upper hinge is located behind the lower hinge over the entire stroke of the movable base plate when the movable base plate moves from the low position to the high position.

5. The walking aid wheelchair according to claim 1, comprising at least one second arm which extends between the chassis and the movable base plate.

6. The walking aid wheelchair according to claim 4, wherein the first arms are substantially parallel to each other, wherein the arms are laterally connected to the movable base plate, wherein the position changing device is configured so that the user is between the first arms, at least when the movable base plate is in the high walking position.

7. The walking aid wheelchair according to claim 6, wherein the first arms, the movable base plate and the chassis together have a generally parallelogram shape deformable between the high position and the low position.

8. The walking aid wheelchair according to claim 1, wherein the position changing device is configured to move the movable base plate relative to the chassis in a circumferential translational motion between the high walking position and the low sitting position.

9. The walking aid wheelchair according to claim 8, wherein a lower end and/or an upper end of each first arm are configured to form an angle between 50° and 90° counterclockwise with the horizontal.

10. The walking aid wheelchair according to claim 1, wherein the upper mechanical connection of the linear actuator is located behind the lower mechanical connection of the linear actuator, at least when the movable base plate is in the high position.

11. The walking aid wheelchair according to claim 1, wherein the absolute value of the angle between the linear actuator and the normal to the corresponding arm in the low position is lower than the absolute value of the angle between this linear actuator and the normal to the corresponding arm in the high position.

12. The walking aid wheelchair according to claim 1, comprising a front retaining member configured to retain the user from moving forward relative to the chassis, wherein the front retaining member comprises a front abutment element configured to abut against the user's pelvis in the high position.

13. The walking aid wheelchair according to claim 12, wherein the front retaining member is configured to guide the wheelchair, at least when the movable base plate is in the high walking position.

14. The walking aid wheelchair according to claim 1, comprising a push rear member which is movably connected to the movable base plate, wherein the push rear member comprises at least one rear abutment element to abut against the rear of one of the user's lower limbs in the high position, wherein the push rear member comprises a return means comprising a spring and wherein the return means is configured to bias the rear abutment element forward.

15. The walking aid wheelchair according to a claim 1, comprising a lock for locking the movable base plate in the low sitting position and/or the high walking position.

* * * * *